US005981159A

United States Patent [19]

Nielsen et al.

[11] Patent Number: 5,981,159

[45] Date of Patent: Nov. 9, 1999

[54] PHOTOGRAPHIC MATERIAL

[75] Inventors: Ralph Bendt Nielsen, San Jose, Calif.; David Francis Bates, Gainesville, Fla.; Brian Thomas, Pittsford, N.Y.

[73] Assignee: Eastman Kodak Company, Rochester, N.Y.

[21] Appl. No.: 08/997,494

[22] Filed: Dec. 23, 1997

Related U.S. Application Data

[63] Continuation-in-part of application No. 08/721,864, Sep. 27, 1996, abandoned.

[51] Int. Cl.[6] ..... G03C 1/08; G03C 7/26; G03C 7/32

[52] U.S. Cl. ..... 430/546; 430/545; 430/552; 430/553; 430/556; 430/557; 430/935; 430/631; 430/637

[58] Field of Search ..... 430/545, 546, 430/552, 553, 556, 557, 935, 631, 637

[56] References Cited

U.S. PATENT DOCUMENTS

| | | | |
|---|---|---|---|
| 3,619,195 | 11/1971 | Van Campen | 430/546 |
| 4,203,716 | 5/1980 | Chen | 430/207 |
| 4,840,885 | 6/1989 | Peters et al. | 430/559 |
| 4,857,449 | 8/1989 | Ogawa et al. | 430/546 |
| 4,939,077 | 7/1990 | Helling et al. | 430/527 |
| 5,001,045 | 3/1991 | Furutachi et al. | 430/545 |
| 5,015,566 | 5/1991 | Dappen et al. | 430/567 |
| 5,047,314 | 9/1991 | Sakai et al. | 430/505 |
| 5,055,386 | 10/1991 | Hirano et al. | 430/546 |
| 5,066,572 | 11/1991 | O'Connor et al. | 430/503 |
| 5,200,304 | 4/1993 | Yoneyama et al. | 430/505 |
| 5,242,788 | 9/1993 | Takahashi et al. | 430/546 |
| 5,294,527 | 3/1994 | Deguchi | 430/545 |
| 5,300,417 | 4/1994 | Lushington et al. | 430/536 |
| 5,310,639 | 5/1994 | Lushington et al. | 430/539 |
| 5,491,052 | 2/1996 | VanMeter et al. | 430/545 |
| 5,558,980 | 9/1996 | Nielsen et al. | 430/546 |
| 5,594,047 | 1/1997 | Nielsen et al. | 523/315 |
| 5,830,631 | 11/1998 | Hendricks et al. | 430/543 |

*Primary Examiner*—Geraldine Letscher
*Attorney, Agent, or Firm*—Andrew J. Anderson

[57] ABSTRACT

A photographic element is disclosed comprising a support bearing at least one light sensitive silver halide emulsion layer comprising a dispersion of a dye-forming coupler and a water-insoluble polymer, wherein the polymer has a glass transition temperature of less than 75° C. and is formed from at least 30 wt % monomer units which provide the polymer with functional groups that are hydrogen bond donors. The combination of such relatively low $T_g$ polymers with couplers in photographic elements leads to both decreased pressure sensitivity and improved image-dye light stability, as well as a decreased tendency toward dye smear or thermal induced change. The advantages of the invention are particularly useful for yellow coupler dispersions used in photographic color paper elements on reflective supports, although they will also be useful for motion picture print film and other projection or display films on transparent or diffuse supports.

27 Claims, No Drawings

PHOTOGRAPHIC MATERIAL

CROSS REFERENCE TO RELATED APPLICATIONS

This application is a continuation-in-part of U.S. application Ser. No. 08/721,864, filed Sep. 27, 1996, now abandoned from which priority is claimed, the entire disclosure of which is hereby incorporated by reference herein.

FIELD OF THE INVENTION

The present invention relates to a photographic material with decreased pressure sensitivity which provides images with improved color light stability. More particularly, it relates to a photographic material with a light sensitive layer comprising a polymer containing coupler dispersion wherein the polymer contains hydrogen-bond donating groups and has a glass transition temperature of less than 75° C.

BACKGROUND OF THE INVENTION

Polymer containing dispersions of photographic couplers have been employed in photographic materials, as described, e.g., in U.S. Pat. Nos. 4,857,449; 5,001,045; 5,047,314; 5,055,386; 5,200,304; 5,242,788; 5,294,527. A main advantage of polymer-containing dispersions described in the prior art relates to image preservability to heat and light, although other advantages in manufacturing processes, physical performance of the photographic element, and sensitometric performance have been reported. Methods for preparing polymer-containing dispersions of dye-forming couplers are described in, e.g., U.S. Pat. Nos. 4,939,077; 4,203,716; and 4,840,885. Commonly, these dispersions are prepared from a solution of a coupler, an optional high-boiling solvent, an oil-soluble but water-insoluble polymer, and a volatile organic solvent, which solution is then emulsified and dispersed in an aqueous solution, often comprising water, a hydrophilic colloid such as gelatin, and a surfactant. Other methods describe the formation of loaded latex polymer dispersions using water-miscible or volatile organic solvent.

Preferred polymer compositions reported in the prior art have generally focused on relatively high glass transition temperature ($T_g$) alkylacrylamide polymers such as poly(t-butylacrylamide) and other high $T_g$ polymers such as styrene/methylmethacrylate copolymers. Poly(t-butylacrylamide) has a $T_g$ near 146° C. in the dry state, and styrene/methylmethacrylate copolymers will have $T_g$'s greater than about 1000° C. Such prior disclosures typically indicate polymers having $T_g$ greater than 60° C. are preferred, and more preferably greater than 90° C., for light stability of formed image dyes.

Despite the benefit of light stability provided by polymers such as poly(t-butylacrylamide), several concerns have been raised with the use of this technology. Elements with the high $T_g$ polymer-containing coupler dispersions, e.g., may be more pressure sensitive compared to conventional solvent coupler dispersions. Additionally, conditions of heat and humidity can cause smearing of the formed image dye in a final print, leading to density increases that show up visually as a color shift. This phenomenon, referred to herein as TIC (Thermally Induced Change), may occur in hot, humid oven-keeping tests of photographic elements over several hours or days, or it can occur very quickly in overly harsh drymount press conditions.

Previous work with pressure-sensitive emulsion layers in color negative materials had shown that low $T_g$ materials coated adjacent to or in the pressure sensitive layer could decrease the signal (see, e.g., U.S. Pat. Nos. 5,015,566; 5,066,572; 5,300,417; 5,310,639). Use of many relatively low $T_g$ polymers such as polybutylacrylate, however, has been found to be much less effective than use of the high $T_g$ poly(t-butylacrylamide) at stabilizing dyes to light fade, and that at the higher levels of polymer needed for image stability, TIC dye smear is generally more severe with the lower $T_g$ polymers.

It may also be desirable to provide even more light stability beyond what is practically achievable with the high $T_g$ polymers preferred in the prior art. In many polymer/coupler systems, e.g., while additional polymer may improve light stability, it is at the impractical expense of much worsened pressure sensitivity and/or TIC. A related set of trade-offs exists with variation of polymer latex particle size. Smaller sized latex particles offer improved image light stability, but at the expense of much worsened TIC and perhaps somewhat worsened pressure sensitivity. In the face of these direct trade-offs, no formulation options have been previously proposed to simultaneously improve all three properties.

SUMMARY OF THE INVENTION

In accordance with one embodiment of the invention, a photographic element is disclosed comprising a support bearing at least one light sensitive silver halide emulsion layer comprising a dispersion of a dye-forming coupler and a water-insoluble polymer, wherein the polymer has a glass transition temperature of less than 75° C. and is formed from at least 30 wt % monomer units which provide the polymer with functional groups that are hydrogen bond donors.

We have found that the combination of such relatively low $T_g$ polymers with couplers in photographic elements can surprisingly lead to both decreased pressure sensitivity and improved image-dye light stability, as well as a decreased tendency toward dye smear or TIC. The advantages of the invention are particularly useful for photographic color paper elements on reflective supports, although they will also be useful for motion picture print film and other projection or display films on transparent or diffuse supports.

DETAILED DESCRIPTION OF THE INVENTION

The invention will now be described in greater detail. While the invention will be described primarily with reference to a typical color paper format, it will be readily apparent to the artisan that the invention will equally apply to additional photographic element formats. Red or red light generally means actinic radiation or light of a wavelength of between about 600 and 750 nm, green or green light generally means light of a wavelength between about 500 and 600 nm while blue or blue light generally means light have a wavelength of between about 400 and 500 nm. In the same vein, dyes which primarily absorb red light are referred to as cyan dyes, dyes which primarily absorb green light are referred to as magenta dyes and dyes which primarily absorb blue light are referred to as yellow dyes. Unless otherwise indicated, dye densities are reported as Status M densities the measurement of which is described at T. H. James, Ed., "The Theory of the Photographic Process," Macmillan, New York, 1977, 4th edition, pages 520–521.

Photographic paper elements typically comprise a red light sensitive color record capable of forming a cyan dye deposit, a green light sensitive color record capable of forming a magenta dye deposit and a blue light sensitive color record capable of forming a yellow dye deposit. The dye deposits will typically be formed during a development step which comprises contacting the element with a basic solution and a paraphenylene diamine development agent to reduce silver halide to silver metal with concomitant production of an oxidized form of color developer. This oxidized color developer in turn reacts with a photographic coupler to form the chromogenic cyan, magenta and yellow dye images, all as known in the art. The couplers may be monomeric or polymeric in nature. The development step may be amplified by the presence of peroxides as known in the art. The photographic element may then be optionally desilvered using any technique known in the art. The element may comprise a reflective support, such as that used in color papers, or a transparent support such as that used in projection display materials. The components, assembly and processing of color photographic materials are described in detail at *Research Disclosure* Item 17643, 1978; Item 18716, 1979; Item 308119, 1989; and Item 36544, 1994, all published by Kenneth Mason Publications, Ltd., The Old Harbormaster's 8 North Street, Emsworth, Hampshire P010 7DD, England, the disclosures of which are incorporated by reference. Materials and methods useful in the preparation of color photographic display materials are additionally described at T. H. James, Ed., "The Theory of the Photographic Process," Macmillan, New York, 1977; "The Kirk-Othmer Encyclopedia of Chemical Technology," John Wiley and Sons, New York, 1993; Neblette's "Imaging Processes and Materials," Van Nostrand Reinhold, New York, 1988; and Keller, Ed. "Science and Technology of Photography, VCH, New York, 1993. Materials useful in the preparation of color papers are further illustrated by current commercial practice as, for example, by EDGE™, PORTRA™ or SUPRA™, Color Papers as sold by Eastman Kodak Company, by FUJI™ FA-family Color Papers as sold by Fuji Photo Film, by KONICA™ QA-family Color Papers as sold by Konishiroku Industries, by DURATRANS™ and DURACLEAR™ display films as sold by Eastman Kodak Company and by KONSENSUS-II™ display films as sold by Konishiroku Industries. The advantages of the current invention may be achieved by modifying any of these formulations to conform to the requirements set forth in the specification. The exact magnitude of the benefits achieved will, of course, depend on the exact details of the formulations involved but these will be readily apparent to the skilled practitioner.

It is contemplated that photographic elements, and specifically color photographic paper elements, according to the present invention will further comprise ultraviolet absorber dyes and soluble dyes removed during processing, all as known in the art. Additionally, the elements may comprise a substituted pyrazolotriazole or a substituted 3-aminopyrazolone magenta dye-forming image coupler which may be a four equivalent coupler but is preferably a two equivalent coupler. The term "equivalent" indicates the formal stoichiometric relationship between the number of moles of silver reduced per mole of image dye formed in a coupling reaction. The couplers and coupler mixtures described at U.S. Pat. Nos. 5,091,297; 5,270,153; 4,675,280; 4,755,455; 4,954,431; 5,110,718; 5,084,375; 4,600,688; 4,443,536; and 4,830,955 are additionally useful in the practice of this invention.

While photographic elements comprising the dispersions of the invention can be single color elements, preferred elements are multicolor elements. Multicolor elements contain image dye-forming units sensitive to each of the three primary regions of the spectrum described above. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Couplers that may be used in the color photographic display elements of the invention can be defined as being 4-equivalent or 2-equivalent depending on the number of atoms of $Ag^+$ required to form one molecule of dye. It is generally preferred to use 2-equivalent couplers in color paper elements in the interest of reducing silver levels. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler-Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,09,6; 570,006; and 574,948.

Typical cyan couplers are represented by the following formulas:

CYAN-1

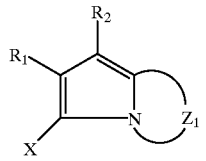

CYAN-2

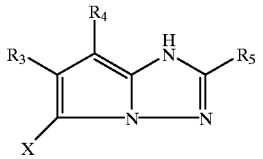

CYAN-3

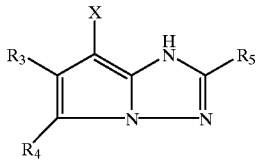

CYAN-4

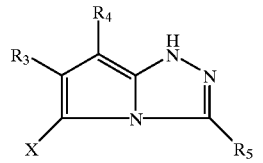

CYAN-5

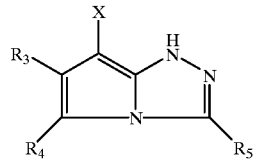

CYAN-6

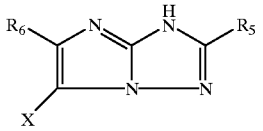

wherein $R_1$ and $R_5$ each represent a hydrogen or a substituent; $R_2$ represents a substituent; $R_3$ and $R_4$ each represent an electron attractive group having a Hammett's substituent constant $s_{para}$ of 0.2 or more and the sum of the $s_{para}$ values of $R_3$ and $R_4$ is 0.65 or more; $R_6$ represents an electron attractive group having a Hammett's substituent constant $s_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group.

More preferable are cyan couplers of the following formulas:

CYAN-7

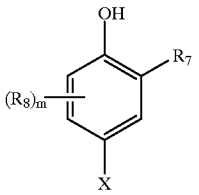

-continued

CYAN-8

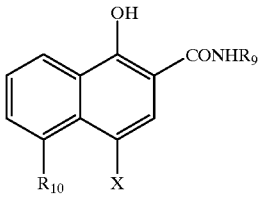

wherein $R_7$ represents a substituent (preferably a carbamoyl, ureido, or carbonamido group); $R_8$ represents a substituent (preferably individually selected from halogen, alkyl, and carbonamido groups); $R_9$ represents ballast substituent; $R_{10}$ represents a hydrogen or a substituent (preferably a carbonamido or sulphonamido group); X represents a hydrogen or a coupling-off group; and m is from 1–3. Cyan couplers of the structure CYAN-7 are most preferable.

A dissociative group has an acidic proton, e.g. —NH—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler-Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

Typical pyrazoloazole and pyrazolone couplers are represented by the following formulas:

MAGENTA-1

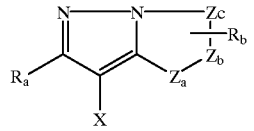

MAGENTA-2

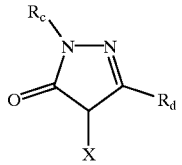

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$.

The polymer containing coupler dispersion of the invention are most useful with yellow dye-forming couplers, which have been found to be most subject to undesirable light fade. Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler-Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510, 535; 524,540; 543,367; and U.S. Pat. No. 5,238,803.

Typical preferred yellow couplers are represented by the following formulas:

YELLOW-1

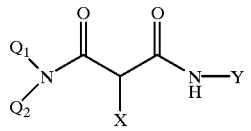

YELLOW-2

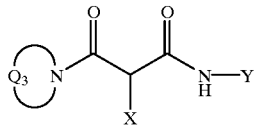

YELLOW-3

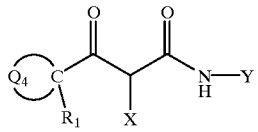

YELLOW-4

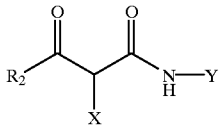

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

To obtain a satisfactory color and tonal balance as photographic images fade on exposure to light, it is important to achieve a balanced rate of density loss from yellow, magenta and cyan dyes. It is particularly desirable to produce a balanced rate of yellow and magenta dye loss in order to maintain a pleasing reproduction of skin tones. In accordance with preferred embodiments of the invention, a balanced rate of fade can be achieved using a yellow dye-forming dispersion comprising a polymer of this invention in combination with a highly-stable pyrazolotriazole magenta dye-forming coupler dispersion.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Typical examples of photographic substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

It may be useful to use a combination of couplers any of which may contain known ballasts or coupling-off groups such as those described in U.S. Pat. Nos. 4,301,235; 4,853,319 and 4,351,897.

Typical couplers that can be used in the polymer containing coupler dispersions and the elements of this invention include those shown below.

C-1
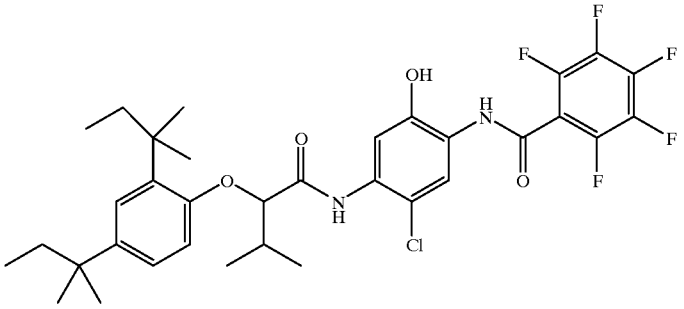
C-2
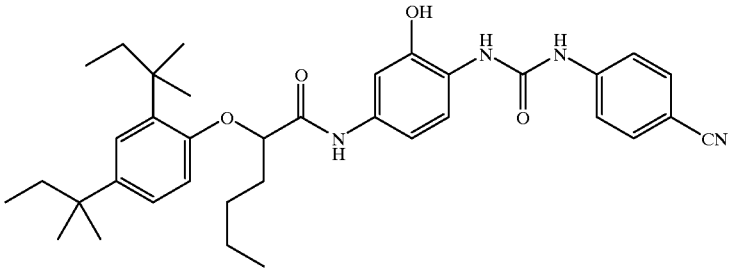
C-3
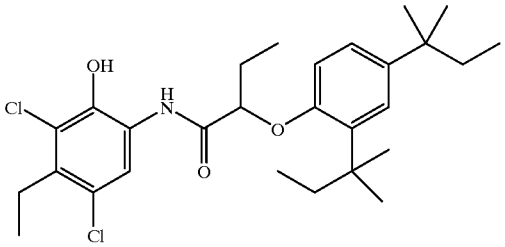
C-4
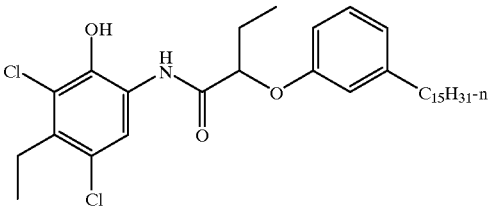
C-5
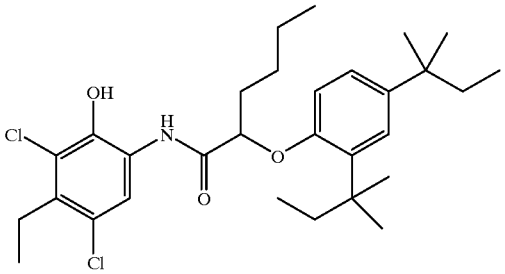
C-6
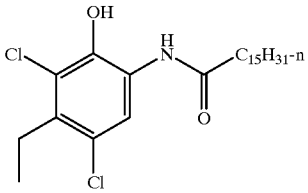

-continued
C-7
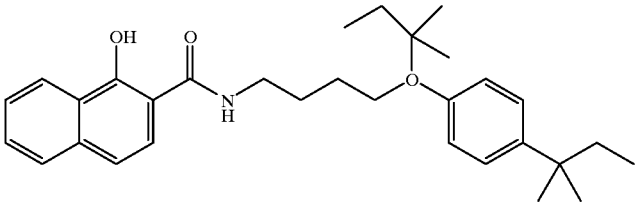
C-8
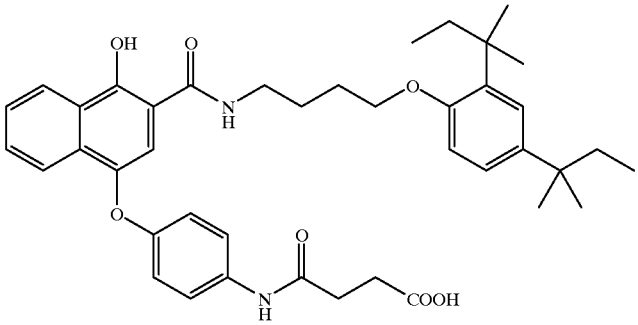
C-9
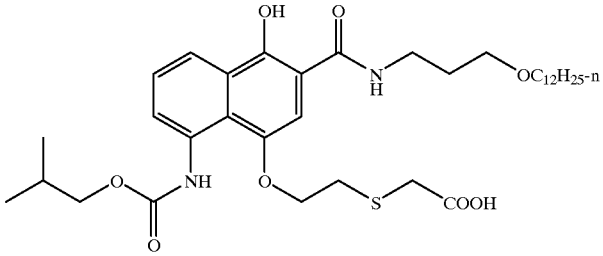
C-10
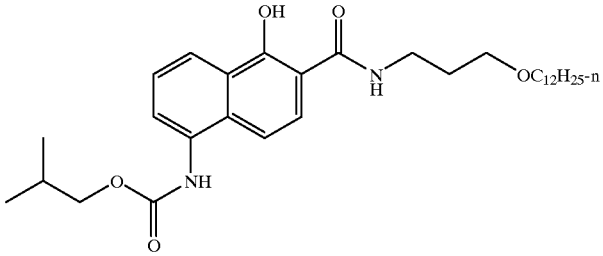
C-11
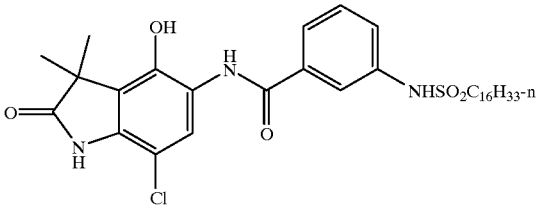

-continued
C-12
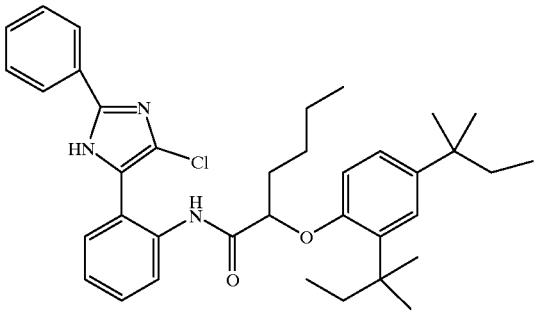
C-13
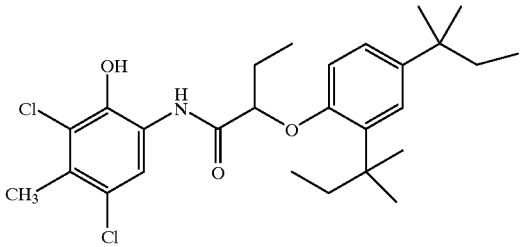
M-1
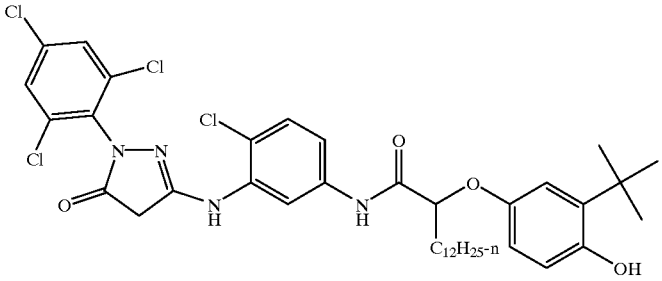
M-2
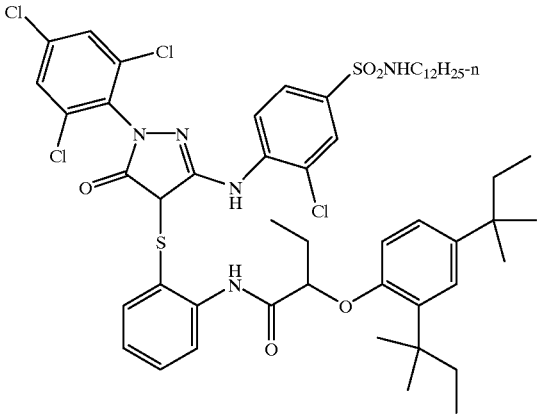

-continued
M-3
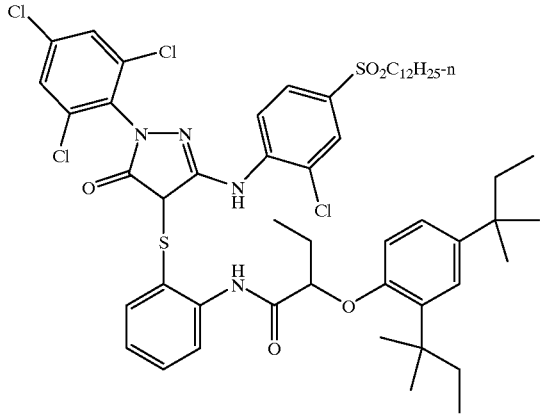
M-4
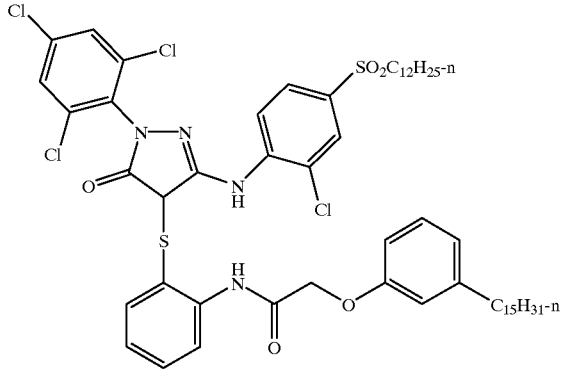
M-5
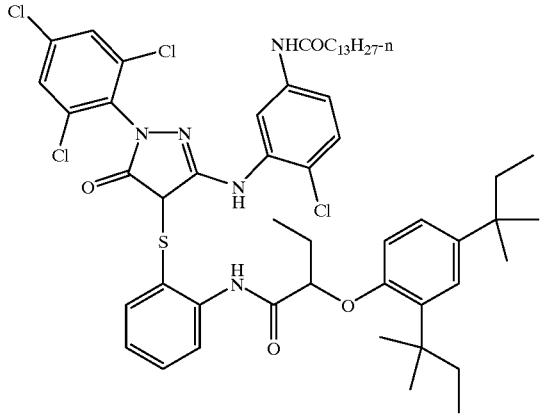
M-6
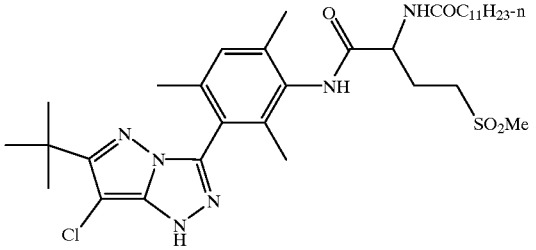

-continued
M-7
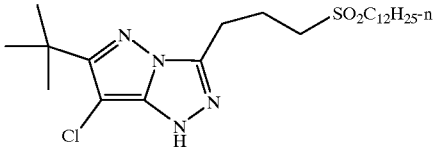
M-8
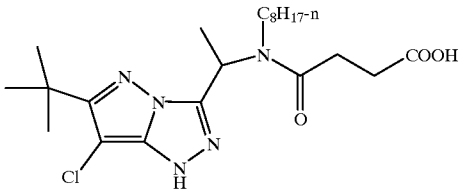
M-9
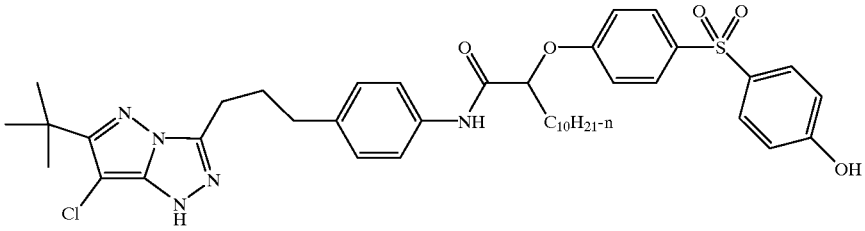
M-10
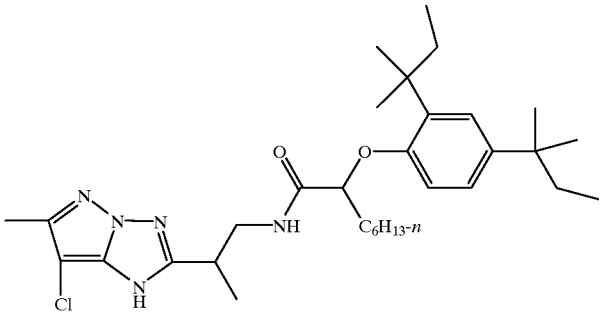
M-11
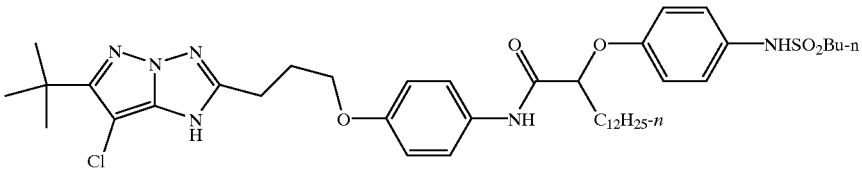
M-12
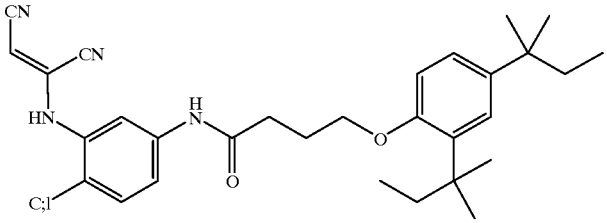
M-13
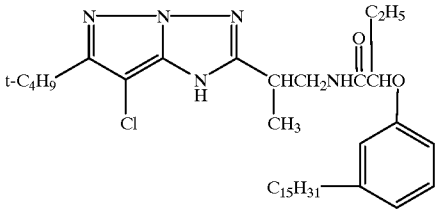

-continued
Y-1
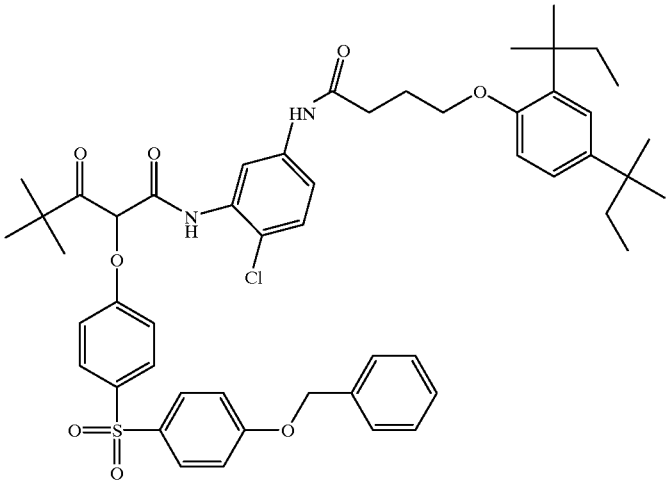
Y-2
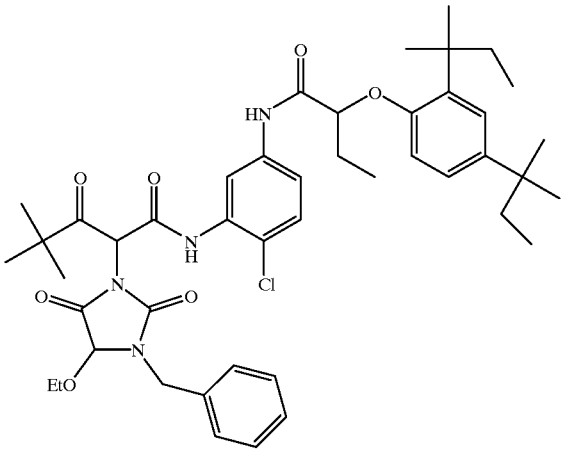
Y-3
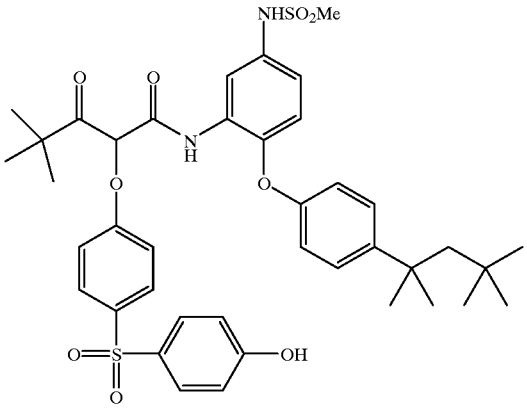

-continued
Y-4
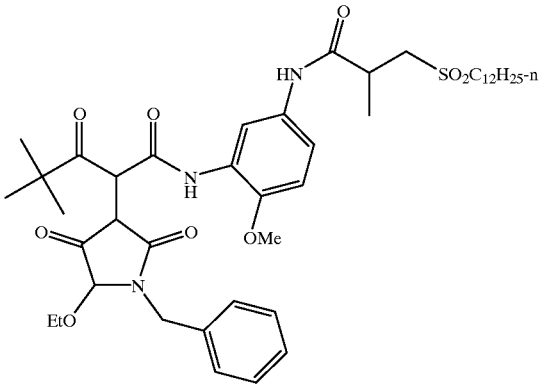
Y-5
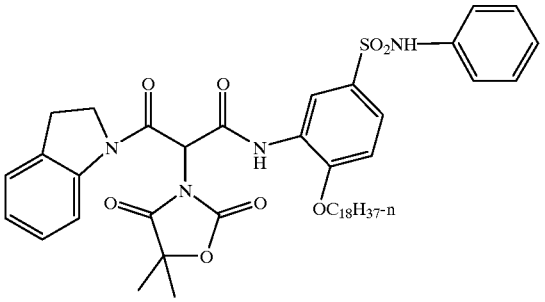
Y-6
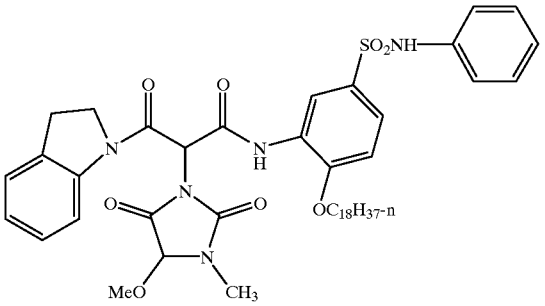
Y-7
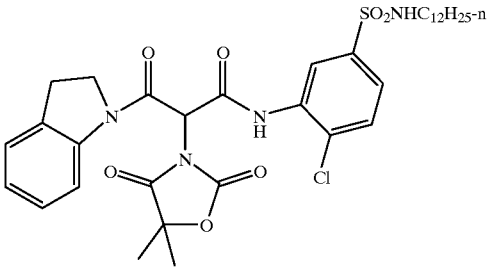
Y-8
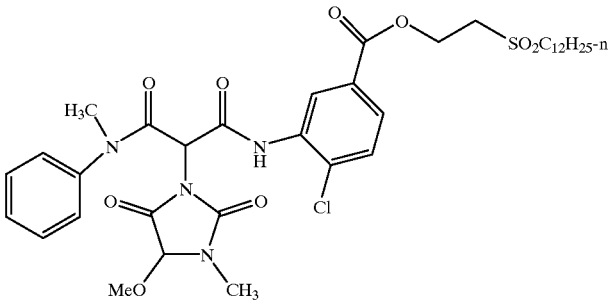

-continued
Y-9
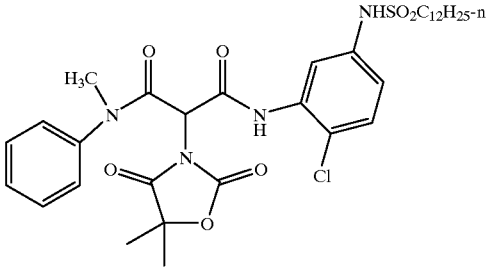
Y-10
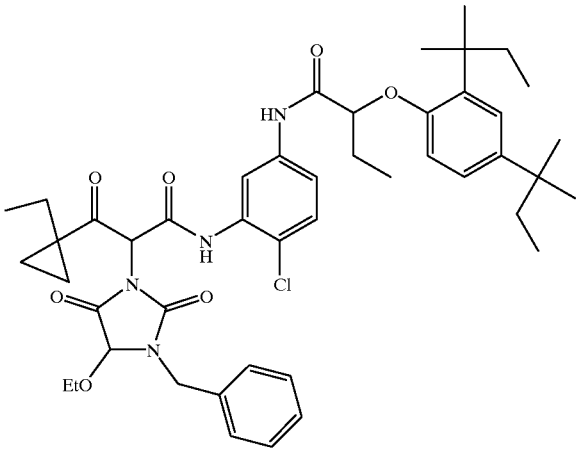
Y-11
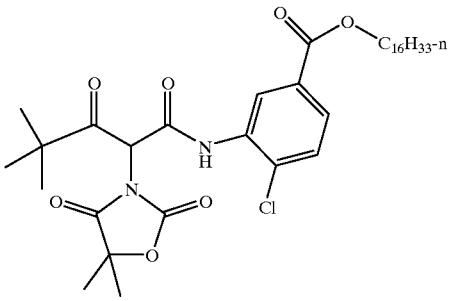
Y-12
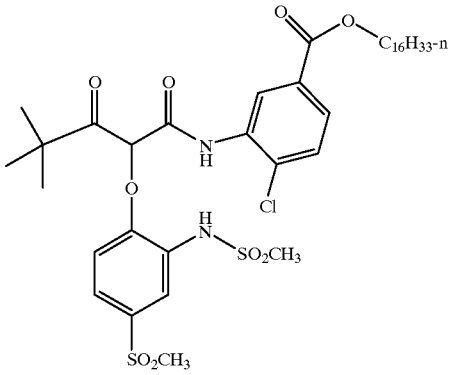

-continued
Y-13
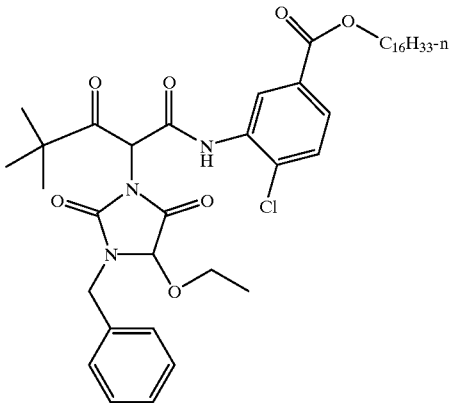
Y-14
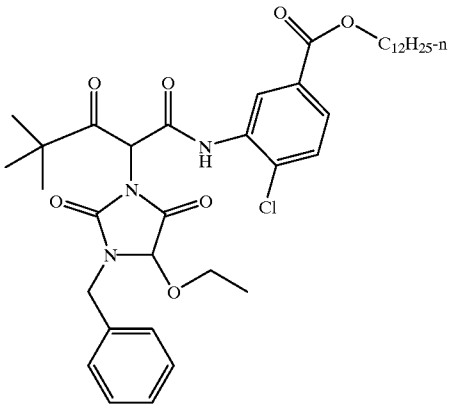
Y-15
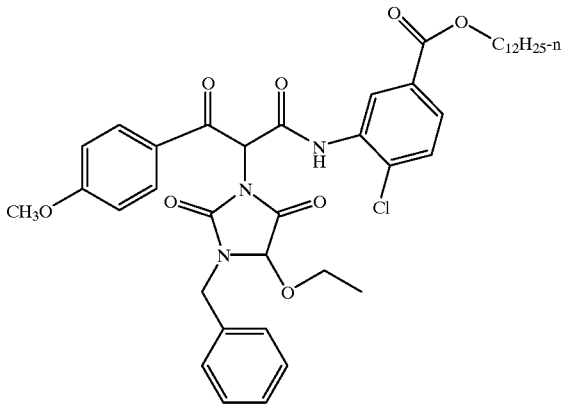

-continued

Y-16

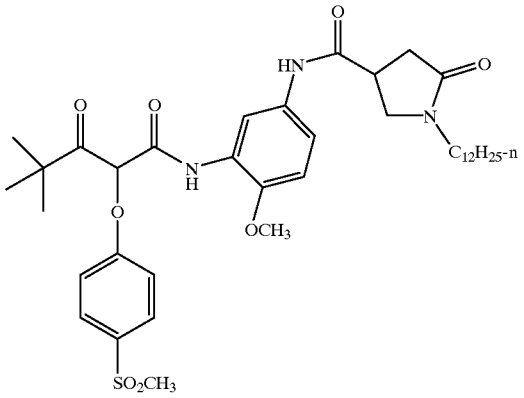

Y-17

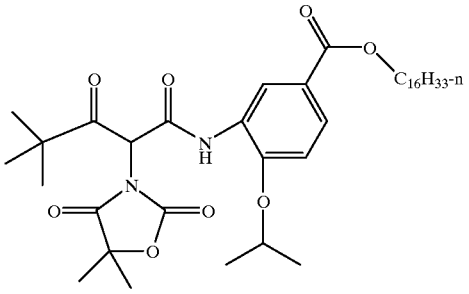

Polymer containing coupler dispersions used in the elements of the invention may be prepared by emulsifying a mixed oil solution comprising the polymer and the dye-forming coupler, as described, e.g., in U.S. Pat. Nos. 3,619,195 and 4,857,449.

In accordance with a preferred embodiment, polymer-containing dispersions of the dye-forming coupler used in the elements of the invention may also be prepared as loaded latex dispersions. These may be prepared according to at least three types of processes. The first process, described in, e.g., U.S. Pat. No. 4,203,716, involves dissolving a hydrophobic photographically useful compound to be loaded in a volatile or water miscible auxiliary solvent, combining this solution with an aqueous solution containing a polymer latex, and diluting the dispersion with additional aqueous solution or evaporating the auxiliary solvent to cause loading to occur. A second, more preferred method for preparing loaded latex formulations is to subject an oil solution or an aqueous dispersion of an oil solution comprising photographically useful compounds, to conditions of high shear or turbulence, in the presence of a polymer latex, with sufficient shear to cause loading as described in U.S. Pat. No. 5,594,047, the disclosure of which is hereby incorporated by reference in its entirety. A third possible way to prepare some loaded latex formulations is to simply combine a polymer latex with a dispersed oil solution free of volatile organic solvent, such that the oil solution and latex are miscible, in the presence of surfactant, for a sufficient time before the dispersion is coated for loading to occur as described in U.S. Pat. No. 5,558,980, the disclosure of which is hereby incorporated by reference in its entirety.

Polymers used in the invention are sufficiently hydrophobic to be incorporated as components of the hydrophobic dispersed phase of the dispersions used in the elements of the invention. The polymers may be prepared by bulk polymerization or solution polymerization processes. Especially preferred among possible polymerization processes is the free-radical polymerization of vinyl monomers in solution.

Preferred latex polymers for use in accordance with the invention include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers which form water-insoluble homopolymers are preferred, as are copolymers of such monomers, which may also comprise monomers which give water-soluble homopolymers, if the overall polymer composition is sufficiently water-insoluble to form a latex (e.g., copolymers may comprise limited amounts of ionic monomers (e.g., about 1–10 wt %), so long as the copolymer remains substantially water insoluble).

In accordance with the invention, the polymer has a glass transition temperature of less than 75° C. and is formed from at least 30 wt % monomer units which provide the polymer with functional groups that are hydrogen bond donors. Examples of suitable hydrogen bond donor groups include carboxamides, sulfonamides, ureas, urethanes, heterocyclic rings containing N—H groups, etc. Examples of such monomers include the following: N-vinyl formamide, N-vinyl acetamide, crotonic acid amides, alkylaminocarbonyloxy alkylacrylates (such as butylaminocarbonyloxy ethylacrylate), and acrylamides and methacrylamides (such as acrylamide, methacrylamide, N-methylacrylamide, N-isopropylacrylamide, N-s-butylacrylamide, N-t-butylacrylamide, N-cyclohexylacrylamide, N-(3-aminopropyl)methacrylamide hydrochloride, N-(3-dimethylaminopropyl)methacrylamide hydrochloride, N-(1, 1,2-trimethylpropyl)acrylamide, N-(1,1,3,3-tetramethylbutyl)acrylamide, N-(1-phthalamidomethyl) acrylamide, N-butylacrylamide, N-(1,1-dimethyl-3-oxobutyl)acrylamide, N-(2-carboxyethyl)acrylamide, 3-acrylamido-3-methylbutanoic acid, methylene bisacrylamide, etc.).

Examples of additional suitable monomers which may be copolymerized with the H-bond donating monomers include: allyl compounds such as allyl esters (e.g., allyl acetate, allyl caproate, etc.); vinyl ethers (e.g., methyl vinyl ether, butyl vinyl ether, methoxyethyl vinyl ether, ethoxyethyl vinyl ether, chloroethyl vinyl ether, 1-methyl-2,2-dimethylpropyl vinyl ether, hydroxyethyl vinyl ether, diethylene glycol vinyl ether, dimethylaminoethyl vinyl ether, butylamninoethyl vinyl ether, benzyl vinyl ether, tetrahydrofurfuryl vinyl other, etc.); vinyl esters (such as vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, etc.); vinyl heterocyclic compounds (such as N-vinyl oxazolidone, N-vinylimidazole, N-vinylpyrrolidone, N-vinylcarbazole, vinyl thiophene, N-vinylethyl acetamide, etc.); styrenes (e.g., styrene, divinylbenzene, methylstyrene, dimethylstyrene, ethylstyrene, isopropylstyrene, sodium styrenesulfonate, potassium styrenesulfinate, butylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy)styrene, methoxystyrene, 4-methoxy-3-methylstyrene, dimethoxystyrene, chlorostyrene, dichlorostyrene, trichlorostyrene, bromostyrene, iodostyrene, fluorostyrene, methyl vinylbenzoate ester, vinylbenzoic acid, etc.); crotonic acids (such as crotonic acid, crotonate esters (e.g., butyl crotonate, etc.)); vinyl ketones (e.g., methyl vinyl ketone, etc); olefins (e.g., dicyclopentadiene, ethylene, propylene, 1-butene, 5,5-dimethyl-1-octene, etc.); itaconic acids and esters (e.g., itaconic acid, methyl itaconate, etc.), other acids such as sorbic acid, cinnamic acid, methyl sorbate, citraconic acid, chloroacrylic acid mesaconic acid, maleic acid, fumaric acid, and ethacrylic acid; halogenated olefins (e.g., vinyl chloride, vinylidene chloride, etc.); unsaturated nitriles (e.g., acrylonitrile, etc.); acrylic or methacrylic acids and esters (such as acrylic acid, methyl acrylate, methacrylic acid, methyl methacrylate, ethyl acrylate, butyl acrylate, butyl methacrylate, 2-hydroxyethyl methacrylate, 2-acetoacetoxyethyl methacrylate, sodium-2-sulfoethyl acrylate, 2-aminoethylmethacrylate hydrochloride, glycidyl methacrylate, ethylene glycol dimethacrylate, etc.); N,N-dimethylacrylamide, N,N-dipropylacrylamide, sodium N-(1,1-dimethyl-2-sulfoethyl)acrylamide.

In accordance with the invention, it has surprisingly been found that polymer $T_g$ and dye light stability are not intrinsically linked. Rather, polymer H-bond donating capability has been found to be the most important factor for a polymer to improve image dye light stability. While some H-bonding capability is critically important for improvements in light stability, homopolymers of typical relatively high $T_g$ H-bonding monomers are not optimum, and it has surprisingly found that replacing at least some of the H-bonding subunits of such polymers with monomers that increase chain flexibility and hydrophobicity can actually result in improved light stability, while simultaneously improving other photographic properties.

In accordance with a preferred embodiment of the invention, the polymer $T_g$ is lowered as much as possible to improve pressure sensitivity while still maintaining a sufficient amount of H-bond donation to provide light stability. Accordingly, the $T_g$ of the polymer is preferably less than about 60° C., more preferably less than about 45° C., and most preferably less than or equal to about 40° C., while the polymer also preferably is formed from at least about 35 wt % monomer units which provide the polymer with functional groups that are hydrogen bond donors, more preferably at least about 50 wt % of such units.

A preferred embodiment of the invention comprises the use of copolymers with dissimilar monomer units, at least one monomer being capable of H-bond donation, (e.g. t-butylacrylamide, other lower (e.g., $C_3$–$C_8$ alkyl group) alkylacrylamides, etc.) and one being present as a diluent, ideally to lower the polymer $T_g$ and provide additional hydrophobicity (where preferably at least about 20 wt % of such copolymers comprise lower $T_g$ monomers). It is well-known that copolymer properties such as $T_g$, hydrophobicity, etc., are often intermediate between the properties of the relevant homopolymers. Accordingly, it would be expected that the photographic performance of elements comprising copolymers would also be intermediate between elements comprising the homopolymers. The improvements observed using copolymers in accordance with the invention relative to the homopolymers were accordingly unexpected.

General approaches for controlling TIC, or thermal dye smear, in photographic elements comprising polymer containing coupler dispersions include coating more gelatin, coating less dispersion, coating less polymer, and making dispersion droplets larger. These techniques, however, generally degrade dye light stability. It is an advantage that TIC may be unexpectedly reduced in accordance with preferred embodiments of the invention without substantially degrading dye light stability.

A preferred polymer formulation is a 50:50 by weight copolymer of t-butylacrylamide and n-butylacrylate. The butylacrylate homopolymer has a $T_g$ of about −40° C., and is a poor light stabilizer for yellow dye. The t-butylacrylamide homopolymer has a $T_g$ of 146° C. and is a potent light stabilizer, but introduces dye smear and pressure sensitivity at high levels. The 50:50 copolymer has a $T_g$ near 40° C., and results in much reduced pressure sensitivity, reduced dye smear, and improved light stability when used in the yellow layer of a color paper format as a 1:1 by weight replacement for a t-butylacrylamide homopolymer.

Latex polymers generally comprise polymer particles having an average particle diameter of from about 0.02 to 2.0 microns. In a preferred embodiment of the invention, latex particles having an average diameter of from about 0.03 to 0.5 microns are used in the dispersions of the invention. In a more preferred embodiment, latex particles having an average diameter of from about 0.03 to 0.2 microns are used, and particles of average diameters from about 0.04 to 0.1 microns are most preferred. The latex polymer average molecular weight generally ranges from about 1000 to 5,000,000. In a preferred embodiment of the invention, loaded latex dispersions of latex particles having an average molecular weight of from about 50,000 to 5,000,000 are formed. In accordance with a further embodiment of the invention, where the latex polymers comprise crosslinked polymers, their molecular weight may far exceed 5,000,000.

Specific examples of useful polymers and polymer latex materials are given below. Copolymer ratios indicated are weight ratios unless otherwise specified.

| Polymers: | Name | $T_g$ (° C.) |
|---|---|---|
| P-1 | N-tert-butylacrylamide/n-butyl acrylate copolymer (50:50) | 39 |
| P-2 | N-tert-butylacrylamide/n-butyl acrylate/2-acrylamido-2-methylpropane sulfonic acid sodium salt copolymer (49:49:2) | 49 |
| P-3 | N-tert-butylacrylamide/2-ethylhexyl acrylate copolymer (50:50) | 53 |
| P-4 | N-tert-butylacrylamide/ethyl acrylate copolymer (50:50) | 63 |
| P-5 | N-tert-butylacrylamide/n-butyl acrylate copolymer (30:70) | 5 |
| P-6 | N-tert-butylacrylamide/n-butyl acrylate copolymer (40:60) | 26 |
| P-7 | N-tert-butylacrylamide/n-butyl acrylate copolymer (60:40) | 70 |
| P-8 | N-tert-butylacrylamide/2-ethylhexyl acrylate copolymer (50:50) | 54 |
| P-9 | N-tert-butylacrylamide/n-dodecyl acrylate copolymer (50:50) | 56 |
| P-10 | N-tert-butylacrylamide/Poly(propylene glycol) monomethacrylate copolymer (50:50) | 53 |
| P-11 | N-tert-butylacrylamide/ethoxyethyl acrylate copolymer (50:50) | 50 |
| P-12 | N-cyclohexylacrylamide/n-butyl acrylate copolymer (50:50) | |
| P-13 | N-sec-butylacrylamide/n-butyl acrylate copolymer (50:50) | |
| P-14 | N-tert-butylacrylamide/Butyl acrylate/methylene bis acrylamide copolymer (49:49:2) | |
| P-15 | N-iso-propylacrylamide/butyl acrylate copolymer (40:60) | |
| P-16 | (Butylaminocarbonyloxy)ethylacrylate/butyl acrylate copolymer (60:40) | |

Suitable free-radical initiators for the polymerization include, but are not limited to the following compounds and classes. Inorganic salts suitable as initiators include potassium persulfate, sodium persulfate, potassium persulfate with sodium sulfite, etc. Peroxy compounds which may be used include benzoyl peroxide, t-butyl hydroperoxide, cumyl hydroperoxide, etc. Azo compounds which may be used include azobis(cyanovaleric acid), azobis-(isobutyronitrile), 2,2'-azobis(2-amidinopropane) dihydrochloride, etc.

The polymers may additionally comprise photographically useful groups covalently bonded thereto, such as groups which function as photographic couplers, (including yellow, magenta and cyan image-forming couplers, colored or masking couplers, inhibitor-releasing couplers, and bleach accelerator-releasing couplers, dye-releasing couplers, etc.), UV absorbers, dyes, reducing agents (including oxidized developer scavengers and nucleators), stabilizers (including image stabilizers, stain-control agents, and developer scavengers), developing agents, optical brighteners, lubricants, etc.

The elements of the invention may generally comprise a wide range of polymer to dye-forming coupler weight ratios in the light sensitive layers thereof. Preferred ratios are from about 40:1 to 1:10, more preferred ratios being from about 4:1 to 1:5. The polymers and polymer latexes described above may also be incorporated in other layers of the elements of the invention as desired, for example as loaded latex dispersions of other photographically useful compounds.

In the following discussion of suitable materials for use in the emulsions and elements that can be used in conjunction with this photographic element, reference will be made to *Research Disclosure,* September 1994, Item 36544, available as described above, which will be identified hereafter by the term *"Research Disclosure."* The contents of the Research Disclosure, including the patents and publications referenced therein, are incorporated herein by reference, and the Sections hereafter referred to are Sections of the *Research Disclosure,* Item 36544.

The preferred silver halide emulsions employed in the photographic elements of the invention are negative-working. Suitable emulsions and their preparation as well as methods of chemical and spectral sensitization are described in Sections I, and III–IV. Vehicles and vehicle related addenda are described in Section II. Dye image formers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, supports, exposure and processing can be found in Sections XI–XII, XV–XX.

It is also contemplated that the polymer containing coupler dispersions of the invention may be advantageously incorporated into the elements described in an article titled "Typical and Preferred Color Paper, Color Negative, and Color Reversal Photographic Elements and Processing," published in *Research Disclosure,* February 1995, Item 37038.

Various types of hardeners are useful in conjunction with elements of the invention. In particular, bis(vinylsulfonyl) methane, bis(vinylsulfonyl) methyl ether, 1,2-bis (vinylsulfonyl-acetamido) ethane, 2,4-dichloro-6-hydroxy-s-triazine, triacryloyltriazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822.

The invention may also be used in combination with photographic elements containing filter (lye layers comprising colloidal silver sol or yellow, cyan, and/or magenta filter dyes, either as oil-in-water dispersions, latex dispersions or as solid particle dispersions. Additionally, they may be used with elements containing "smearing" couplers (e.g. as described in U.S. Pat. No. 4,366,237; EP 96,570; U.S. Pat. Nos. 4,420,556 and 4,543,323.)

It is specifically contemplated that the concepts of the present invention may be employed to obtain reflection color prints as described in *Research Disclosure,* November 1979, Item 18716, incorporated herein by reference. Materials of the invention may be used in combination with a photographic element coated on pH adjusted support as described in U.S. Pat. No. 4,917,994; with a photographic element coated on support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171.

The emulsions can be surface-sensitive emulsions, i.e., emulsions that form latent images primarily on the surfaces of the silver halide grains, or the emulsions can form internal latent images predominantly in the interior of the silver halide grains. Further, the emulsions that can be used in conjunction with elements of the invention are usually negative-working emulsions. Further, it would be advantageous to use the invention in conjunction with emulsions which give a preferred tone scale as described in co-pending, commonly assigned U.S. patent application Ser. No. 08/199,035 of Bell et al., filed Feb. 18, 1994, entitled "Silver Halide Color Photographic Element With Improved high Density Contrast and Bright Low Density Colors".

Due to a desire for rapid development, preferred emulsions for color paper are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum.

Color paper elements typically contain less than 0.80 $g/m^2$ of total silver. Due to the need to decrease the environmental impact of color paper processing, it is desired to decrease the amount of total silver used in the element as much as possible. Therefore, total silver levels of less than 0.65 $g/m^2$ are preferable, and levels of 0.55 $g/m^2$ are even more preferable. It is possible to reduce further the total silver used in the color paper photographic element to less than 0.10 $g/m^2$ by use of a so-called development amplication process whereby the incorporated silver is used only to form the latent image, while another oxidant, such as hydrogen peroxide, serves as the primary oxidant to react with the color developer. Such processes are well-known to the art, and are described in, for example, U.S. Pat. Nos. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

Red-, green- and blue-sensitive emulsions for use in the elements of the invention can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904, 5,292,634, 5,354,651, and EP Patent Application 93/203193.3, in conjunction with elements of the invention. Polymer containing yellow dye-forming coupler dispersions in accordance with one embodiment of the invention may be advantageously used in combination with short blue sensitization to enable improved color reproduction in photographic display materials as described in copending, commonly assigned U.S. Ser. No. 08/390,442 filed Feb. 17, 1995, the disclosure of which is hereby incorporated by reference herein.

The invention materials may also be used in association with nucleating agents, development accelerators or their precursors (UK Patent 2,097,140; U.K. Patent 2,131,188); electron transfer agents (U.S. Pat. Nos. 4,859,578 and 4,912,025); antifogging and anticolor-mixing agents such as derivatives of hydroquinones, aminophenols, amines, gallic acid; catechol; ascorbic acid; hydrazides; sulfonamidophenols; and non color-forming couplers.

Suitable hydroquinone color fog inhibitors include, but are not limited to compounds disclosed in EP 69,070; EP 98,241; EP 265,808; Japanese Published Patent Applications 61/233,744; 62/178,250; and 62/178,257. In addition, specifically contemplated are 1,4-benzenedipentanoic acid, 2,5-dihydroxy-delta, delta,delta',delta'-tetramethyl-, dihexyl ester; 1,4-Benzenedipentanoic acid, 2-hydroxy-5-methoxy-delta,delta,delta',delta'-tetramethyl-, dihexyl ester; and 2,5-dimethoxy-delta,delta,delta',delta'-tetramethyl-, dihexyl ester.

Various additional image stabilizers that improve image preservability may be used in conjunction with the elements of this invention. Such stabilizers can include any described in the art, including epoxides, sulfinates, hydroxylamines, hindered phenols, bisphenols, electron-rich aromatic compounds, and other polymers.

Various kinds of conventional discoloration inhibitors can also be used in conjunction with elements of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato) nickel complex can be employed as a discoloration inhibitor. Specific examples of the organic discoloration inhibitors are described below. For instance, those of hydroquinones are disclosed in U.S. Pat. Nos. 2,360,290; 2,418,613; 2,700,453; 2,701,197; 2,710,801; 2,816,028; 2,728,659; 2,732,300; 2,735,765; 3,982,944 and 4,430,425; and British Patent 1,363,921; and so on; 6-hydroxychromans, 5-hydroxycoumarans, spirochromans are disclosed in U.S. Pat. Nos. 3,432,300; 3,573,050; 3,574,627; 3,698,909 and 3,764,337; and Japanese Published Patent Application 52-152,225; and so on; spiroindanes are disclosed in U.S. Pat. No. 4,360,589; those of p-alkoxyphenols are disclosed in U.S. Pat. No. 2,735,765; British Patent 2,066,975; Japanese Published Patent Applications 59-010,539 and 57-019,765; and so on; hindered phenols are disclosed, for example, in U.S. Pat. Nos. 3,700,455; 4,228,235; Japanese Published Patent Applications 52-072,224 and 52-006,623; and so on; gallic acid derivatives, methylenedioxybenzenes and aminophenols are disclosed in U.S. Pat. Nos. 3,457,079; 4,332,886; and Japanese Published Patent Application 56-021,144, respectively; hindered amines are disclosed in U.S. Pat. Nos. 3,336,135; 4,268,593; British Patents 1,326,889; 1,354,313 and 1,410,846; Japanese Published Patent Applications 51-001,420; 58-114,036; 59-053,846; 59-078,344; and so on; those of ether or ester derivatives of phenolic hydroxy groups are disclosed in U.S. Pat. Nos. 4,155,765; 4,174,220; 4,254,216; 4,279,990; Japanese Published Patent Applications 54-145,530; 55-006,321; 58-105,147; 59-010,539; 57-037,856; 53-003,263 and so on; and those of metal complexes are disclosed in U.S. Pat. Nos. 4,050,938 and 4,241,155.

Stabilizers that can be used with the invention include but are not limited to the following.

ST-1
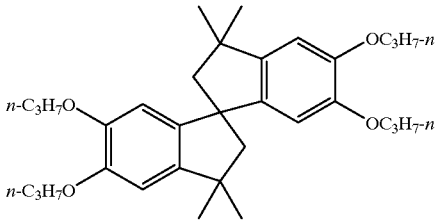
ST-2
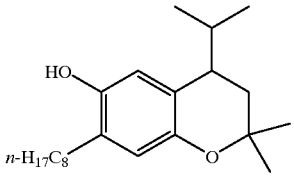
ST-3
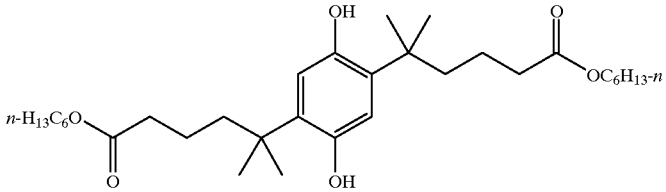
ST-4
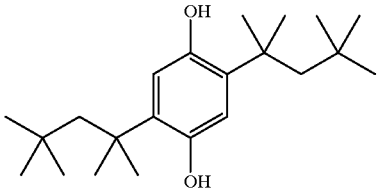
ST-5
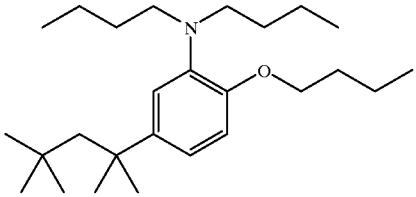
ST-6
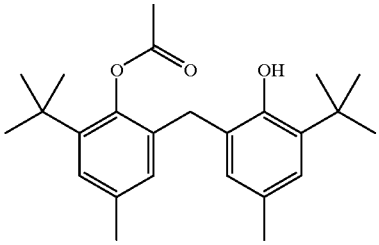
ST-7
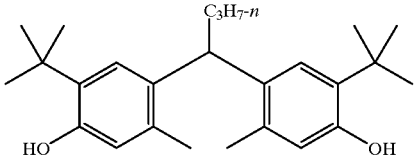

-continued
ST-8
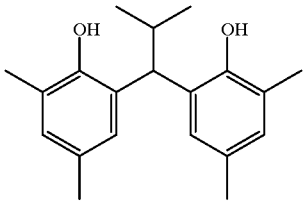
ST-9
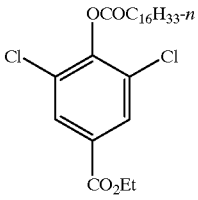
ST-10
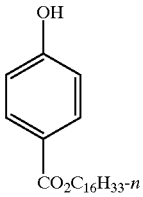
ST-11
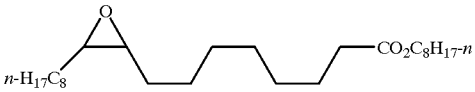
ST-12
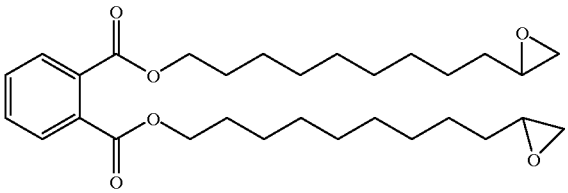
ST-13
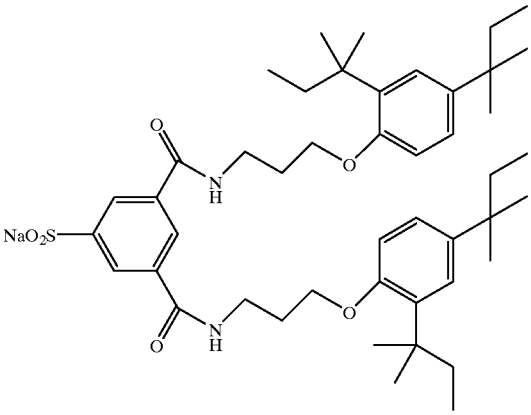
ST-14
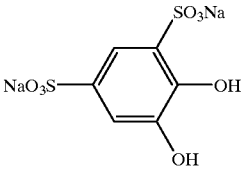

-continued
ST-15
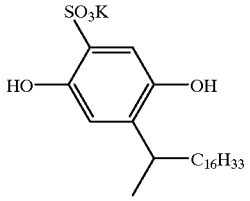
ST-16
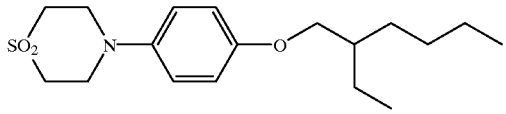
ST-17
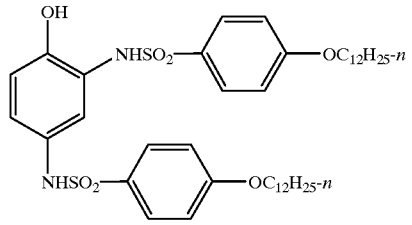
ST-18
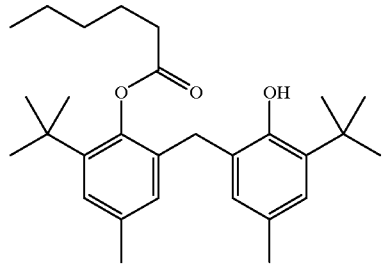
ST-19
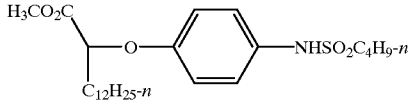
ST-20
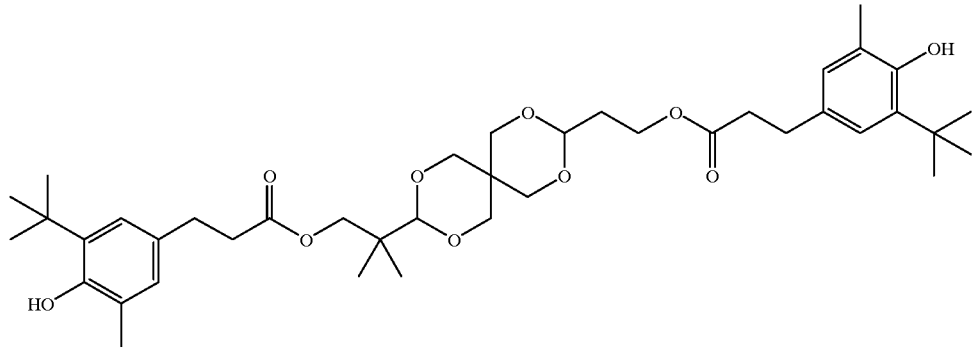
ST-21
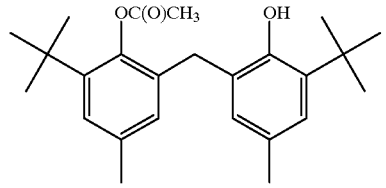

-continued

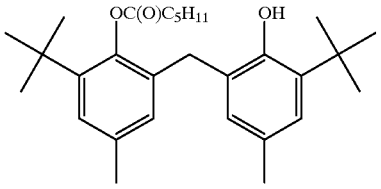

ST-22

The photographic elements of the invention are further anticipated to include UV stabilizers in preferred embodiments. The UV stabilizers may be soluble polymers, polymer latexes, and dispersed compounds. In addition, it is contemplated that materials of this invention may be used with so-called liquid ultraviolet absorbers such as described in U.S. Pat. Nos. 4,992,358; 4,975,360; and 4,587,346. Examples of typical dispersed UV stabilizers are shown below.

UV-1

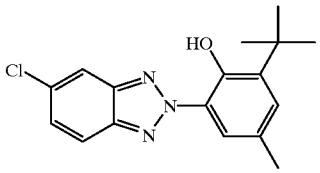

UV-2

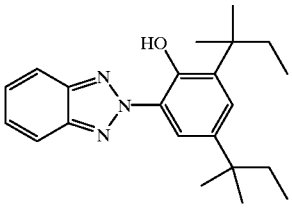

UV-3

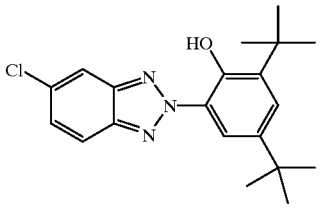

UV-4

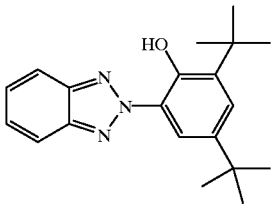

UV-5

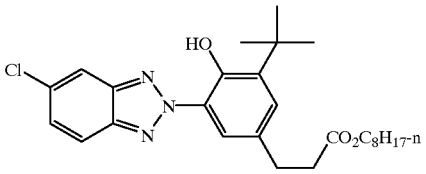

-continued

UV-6

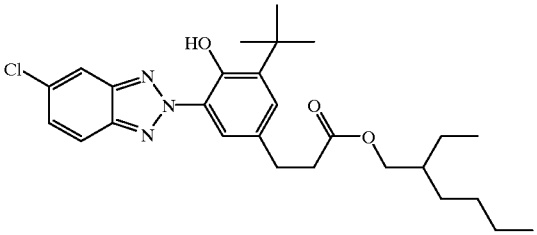

UV-7

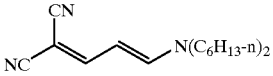

UV-8

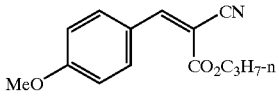

The aqueous phase of the dispersions used in the invention may comprise a hydrophilic colloid, preferably gelatin. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The dispersions and coated layers of the elements of the invention may include surfactants. Surfactants may be cationic, anionic, zwitterionic or non-ionic. Ratios of surfactant to liquid organic solution typically are in the range of 0.5 to 25 wt. % for forming small particle photographic dispersions, which ratios are also useful for forming the invention dispersions. Useful surfactants include, but are not limited to the following.

F-1

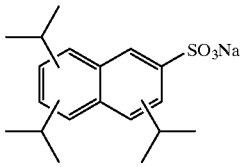

F-2

$CF_3(CF_2)_7SO_3Na$

-continued

F-3

$CH_3(CH_2)_nSO_3Na$, n = 12-14

F-4

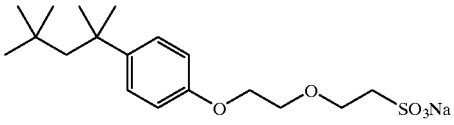

F-5

$CH_3(CH_2)_{11}OSO_3Na$

F-6

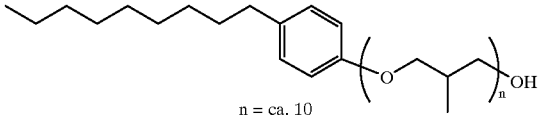

n = ca. 10

F-7

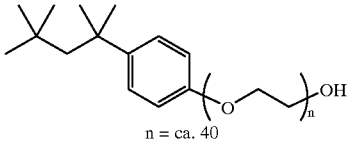

n = ca. 40

F-8

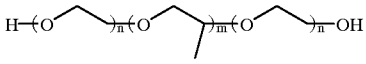

n = ca. 6, m = ca. 22

F-9

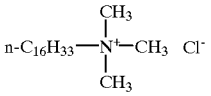

F-10

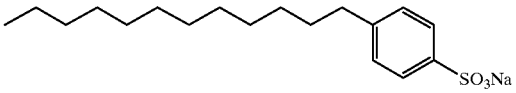

F-11

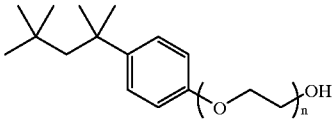

n = ca. 10

F-12

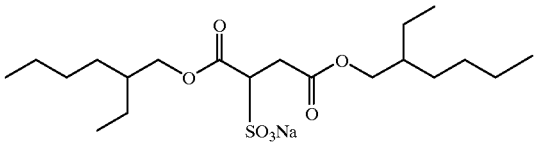

The coupler dispersions in the elements of the invention, as well as dispersions of other photographically useful compounds, may be prepared by means known in the art. The organic, or oil phase, components of such dispersions may include high-boiling organic solvents, known as oil formers, coupler solvents, or permanent solvents. High boiling solvents have a boiling point sufficiently high, generally above 150° C. at atmospheric pressure, such that they are not evaporated under normal dispersion making and photographic layer coating procedures. Non-limitive examples of high boiling organic solvents that may be used include the following.

| | |
|---|---|
| S-1 | Dibutyl phthalate |
| S-2 | Tritolyl phosphate |

-continued

| | |
|---|---|
| S-3 | N,N-Diethyldodecanamide |
| S-4 | Tris(2-ethylhexyl)phosphate |
| S-5 | Octyl oleate monoepoxide |
| S-6 | 2,5-Di-t-pentylphenol |
| S-7 | Acetyl tributyl citrate |
| S-8 | 1,4-Cyclohexylenedimethylene bis(2-ethylhexanoate) |
| S-9 | Bis(2-ethylhexyl)phthalate |
| S-10 | 2-phenylethyl benzoate |
| S-11 | Dibutyl sebacate |
| S-12 | N,N-Dibutyldodecanamide |
| S-13 | Oleyl alcohol |
| S-14 | 2-(2-Butoxyethoxy)ethyl acetate |

Auxiliary solvents may also be included in dispersion making processes. Many useful auxiliary solvents are water immiscible, volatile solvents, and solvents with limited water solubility which are not completely water miscible. Examples of these include the following.

| | |
|---|---|
| A-1 | Ethyl acetate |
| A-2 | Cyclohexanone |
| A-3 | 4-Methyl-2-pentanol |
| A-4 | Triethyl phosphate |
| A-5 | Methylene chloride |
| A-6 | Tetrahydrofuran |

While the polymer containing coupler dispersions of the invention may include permanent coupler solvents, the presence of such solvents in photographic elements is known to be detrimental to the light stability of the dye formed in the development process for many dye-forming couplers. The coupler solvent may also be detrimental to the wet abrasion properties of the emulsion layer. Reduction or elimination of permanent solvent, however, frequently reduces the reactivity of couplers, which may result in development side-reactions which produce products which themselves degrade light stability. An additional problem with dispersions containing substantially no, or a low level (e.g., less than 0.25:1 wt ratio solvent:coupler) of permanent solvent, is increased dry abrasion sensitivity of the silver halide emulsion grains, which may result in a greater propensity to show yellow fog effects at slit edges of color photographic papers employing such dispersions.

In accordance with one embodiment, it has been discovered that the addition of latex polymers in accordance with the invention to no (or low) solvent dispersions eliminates or minimizes the reactivity problems of such dispersions, while also eliminating the dry pressure problems seen with such dispersions. It has been further discovered that addition of a polyoxyalkylene compound to yellow coupler dispersions made with such latex polymers can further boost the reactivity and light stability of such couplers, and may also eliminate thermal density increases. Polyoxyalkylene compounds which may be used include, e.g., those described in U.S. Pat. No. 5,491,052, the disclosure of which is incorporated herein by reference. Preferred polyoxyalkylene compounds include block polymeric or block oligomeric surface active compounds comprising at least a polyoxypropylene (POP) block and a polyoxyethylene (POE) block, such as surfactant F-8 above. Preferably, such compounds are present in the coupler dispersions of the invention at a polyoxyalkylene compound:coupler weight ratio of from 0.05:1 to 0.6:1. The beneficial light stability and wet abrasion properties of no-solvent or low-solvent dispersions without the shortcomings of lower reactivity and dry pressure problems which result from conventional no-solvent dispersion formulations was unexpected.

Devices suitable for high-shear or turbulent mixing of the polymer containing dispersions of the invention include those generally suitable for preparing submicron photographic emulsified dispersions. These include but are not limited to blade mixers, devices in which a liquid stream is pumped at high pressure through an orifice or interaction chamber, sonication, Gaulin mills, homogenizers, blenders, etc. More than one type of device may be used to prepare the dispersions. For the purposes of this invention, "high shear or turbulent conditions" defines shear and turbulence conditions sufficient to generate a small particle conventional aqueous photographic dispersion of a coupler with a coupler solvent with an average particle size of less than about 0.4 micron.

Photographic elements of the invention can be exposed to actinic radiation, typically in the visible region of the spectrum, to form a latent image and can then be processed to form a visible dye image. Processing to form a visible dye image includes the step) of contacting the element with a color developing agent to reduce developable silver halide and oxidize the color developing agent. Oxidized color developing agent in turn reacts with the coupler to yield a dye.

With negative-working silver halide, the processing step described above provides a negative image. It is specifically anticipated that the elements of the invention may be processed in accordance with color print processes, such as the RA-4 process of Eastman Kodak Company as described in the *British Journal of Photography Annual of* 1988, pages 198–199.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, and p-toluene-sulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element: 4-amino-3-methyl-N-ethyl-N-(beta-hydroxyethyl) aniline sulfate; 4-amino-3-methyl-N-ethyl-N-(beta-(methanesulfonamidoethyl) aniline sesquisulfate hydrate; 4-amino-N,N-diethylaniline hydrochloride; 4-amino-3-methyl-N,N-diethylaniline hydrochloride; 4-amino-3-beta-(methanesutifonamido)ethyl-N,N-diethylaniline hydrochloride and 4-amino-N-ethyl-N-(2-methoxyethyl)-m-toluidine di-p-toluene sulfonic acid.

Of these, particularly preferred is the use of 4-amino-3-methyl-N-ethyl-N-(beta-(methane sulfonamidoethyl)aniline sesquisulfate hydrate, in conjunction with color paper photographic elements of the invention.

The invention is further described in the following examples, wherein all polymers were prepared by direct emulsion polymerization, using mixed solid-slurry-emulsion monomer feeds, generally as described in co-pending, commonly assigned U.S. Ser. No. 08/390,449 filed Feb. 17, 1995, the disclosure of which is incorporated by reference herein.

EXAMPLE 1

Dispersions were prepared for various polymer latexes according to the following unit formula., with 7.35% by weight of coupler in the final dispersion.

| | |
|---|---|
| Coupler Y-11 | 1.00 |
| Solvent S-1 (dibutyl phthalate) | 0.683 |
| Surfactant F-1 (dry) | 0.081 |
| acid processed ossein gel | 1.109 |
| polymer latex (dry basis) | 1.00 |
| water (including latex & surfactant F-1) | 9.72 |

Procedure: For each variation, 50 g of final dispersion was prepared. Coupler Y-11 and dibutyl phthalate were combined at 100° C. to make an oil solution, that was then maintained at 80° C. Gelatin and surfactant F-1 were dissolved in water at 80° C., and latex was added to this solution. To this was added the oil solution. The mixture was mixed at 80° C. with an air-driven rotor-stator mixer for 60 s to prepare a coarse dispersion or premix, and this was then homogenized by recycling three turnovers at 10,000 psi through Microfluidizer® homogenizer, to prepare the final dispersion that was then chill set.

Dispersions comprising a latex polymer according to the invention (P-1 indicated above) and comparison polymers (CP-1 through CP-11 indicated below) and different average latex particle sizes were prepared.

| Polymers: | Name | $T_g$ (° C.) |
|---|---|---|
| CP-1 | Poly(N-tert-butylacrylamide) | 146 |
| CP-2 | N-tert-butylacrylamide/2-acrylamido-2-methylpropane sulfonic acid sodium salt copolymer (99:1) | 146 |
| CP-3 | Poly(n-butyl acrylate) | −40 |
| CP-4 | Polystyrene | 108 |
| CP-5 | Poly(methyl acrylate) | 21 |
| CP-6 | Poly(methyl methacrylate) | 105 |
| CP-7 | N-tert-butylacrylamide/methyl acrylate copolymer (75:25) | 113 |
| CP-8 | N-tert-butylacrylamide/methyl methacrylate copolymer (50:50) | 119 |
| CP-9 | N-tert-butylacrylamide/styrene copolymer (75:25) | 136 |
| CP-10 | N-tert-butylacrylamide/styrene copolymer (50:50) | 121 |
| CP-11 | Methyl methacrylate/methyl acrylate copolymer (50:50) | 62 |

The dispersions were coated in a blue-sensitive color paper single-layer format with overcoat. The coating format for testing these dispersions, from the base up, is as follows:

Base: Titanium dioxide loaded polyethylene resin coated photographic paper.

Blue sensitized layer: Blue sensitized cubic silver chloride emulsion having an average cubic edge length of 0.76 $\mu$m coated at 270 mg Ag/m$^2$, Yellow dye forming coupler Y-11 and polymer each coated at 484 mg/m$^2$.

Overcoat: gelatin 1.08 g/m$^2$ and gelatin hardener bis (vinylsulfonyl-methyl) ether at the level of 2% based on total gel in the package.

The coatings were exposed to white light through a gray wedge chart and then processed using standard RA-4 chemistry, described in the British Journal of Photography Annual of 1988, Pp 198–199. Light stability of the yellow dye from initial density of 1.7, 1.0, and 0.5 was measured for each strip after 2 and 3 weeks of high intensity daylight (HID) exposure (50 Klux daylight irradiation) through an external UV filter placed over the strips (containing UV absorbing dyes UV-2 coated at 640 mg/m$^2$ and UV-3 coated at 113 mg/m$^2$). Tendency for dye-smear/TIC was measured with two oven tests, 60° C. and 70% RH and 75° C. and 50% RH for 1, 4 and 6 weeks. Pressure sensitivity was measured by pre-exposure treatment with a rough roller test, wherein the strip was driven through the nip between two burnished steel rollers with a controlled high pressure. The sample was then exposed and processed, and the $D_{min}$ blue density increase in the roller track was determined relative to the $D_{min}$ of the strip not in the track. Results are shown in the following table:

| Sample/ Polymer/ diameter (nm)/ Comparison (C) or Invention (I) | Tg (° C.)/ H-bond yes (Y) or no (N) | Pressure Δ $D_{min}$ | 1 wk 75/50 Δ @ 1.0 | 2 wk HID Δ @ 1.0 | 3 wk HID Δ @ 1.0 |
|---|---|---|---|---|---|
| 1/CP-2/63/C | 146/Y | 0.024 | 0.10 | −0.23 | −0.35 |
| 2/CP-1/32/C | 146/Y | 0.025 | 0.09 | −0.17 | −0.28 |
| 3/CP-1/43/C | 146/Y | 0.022 | 0.06 | −0.17 | −0.30 |
| 4/CP-1/76/C | 146/Y | 0.026 | 0.02 | −0.23 | −0.36 |
| 5/CP-1/104/C | 146/Y | 0.024 | 0.00 | −0.30 | −0.44 |
| 6/CP-7/52/C | 113/Y | 0.016 | −0.01 | −0.18 | −0.30 |
| 7/CP-7/78/C | 113/Y | 0.016 | 0.01 | −0.20 | −0.33 |
| 8/CP-7/96/C | 113/Y | 0.018 | −0.01 | −0.22 | −0.36 |
| 9/CP-5/66/C | 21/N | 0.009 | 0.00 | −0.57 | −0.79 |
| 10/CP-5/79/C | 21/N | 0.008 | −0.01 | −0.57 | −0.80 |
| 11/CP-5/102/C | 21/N | 0.013 | 0.01 | −0.61 | −0.82 |
| 12/CP-8/60/C | 119/Y | 0.018 | 0.00 | −0.17 | −0.27 |
| 13/CP-8/82/C | 119/Y | 0.019 | 0.02 | −0.21 | −0.32 |
| 14/CP-8/100/C | 119/Y | 0.016 | 0.00 | −0.25 | −0.36 |
| 15/CP-10/75/C | 121/Y | 0.015 | 0.02 | −0.16 | −0.28 |
| 16/P-1/63/I | 39/Y | 0.009 | 0.00 | −0.19 | −0.34 |
| 17/P-1/98/I | 39/Y | 0.009 | 0.00 | −0.22 | −0.34 |
| 18/P-1/112/I | 39/Y | 0.009 | 0.01 | −0.23 | −0.37 |
| 19/CP-6/42/C | 105/N | 0.028 | 0.00 | −0.47 | −0.72 |
| 20/CP-6/54/C | 105/N | 0.028 | −0.01 | −0.50 | −0.76 |
| 21/CP-6/78/C | 105/N | 0.028 | −0.01 | −0.57 | −0.80 |
| 22/CP-6/94/C | 105/N | 0.021 | −0.01 | −0.64 | −0.83 |
| 23/CP-11/44/C | 62/N | 0.006 | −0.01 | −0.47 | −0.74 |
| 24/CP-11/72/C | 62/N | 0.014 | −0.02 | −0.54 | −0.78 |
| 25/CP-11/93/C | 62/N | 0.019 | 0.00 | −0.53 | −0.77 |
| 26/CP-9/58/C | 136/Y | 0.023 | 0.00 | −0.17 | −0.26 |
| 27/CP-9/64/C | 136/Y | 0.025 | 0.00 | −0.19 | −0.30 |
| 28/CP-9/108/C | 136/Y | 0.021 | 0.00 | −0.28 | −0.39 |
| 29/CP-4/46/C | 108/N | 0.023 | −0.01 | −0.56 | −0.78 |
| 30/CP-4/67/C | 108/N | 0.024 | 0.00 | −0.56 | −0.79 |
| 31/CP-4/98/C | 108/N | 0.023 | −0.02 | −0.60 | −0.80 |
| 32/CP-3/34/C | −40/N | 0.013 | 0.00 | −0.51 | −0.74 |
| 33/CP-3/54/C | −40/N | 0.010 | 0.01 | −0.56 | −0.79 |
| 34/CP-3/67/C | −40/N | 0.009 | −0.01 | −0.56 | −0.79 |

As can be seen from the various samples, there is a correlation of polymer $T_g$ with the pressure sensitivity of the photographic element. Also, none of the dispersions other than those with polymers rich in t-butylacrylamide monomer show a noticeable blue density increase during oven testing, related to dye smear or TIC. There is no correlation of polymer $T_g$ with light stability of the dye formed in each dispersion, but instead, a correlation with the presence of H-bond donating groups such as t-butylacrylamide monomer subunits. Note particularly that the samples in accordance with the invention comprising a copolymer of butyl acrylate and t-butylacrylamide with a $T_g$ of 39° C., which exhibit low pressure sensitivity and show no blue density increase on oven keeping, combined with light fade performance superior to the t-butylacrylamide homopolymer of similar particle size. Similar results in light stability are expected for polymers of other N-alkylacrylamides with alkyl groups such as n-butyl, sec-butyl, cyclohexyl, etc., where the homopolymers have also been shown to improve light stability.

EXAMPLE 2

A further coating experiment was prepared similarly as in Example 1, looking at copolymers of other monomers that yield homopolymers with low $T_g$ and t-butylacrylamide monomer. All of the polymers have H-bond donating capability. Dispersions were prepared using the same unit formula described above, with 1:1 and 1.4:1 polymer:coupler ratios of the various polymers.

| Sample/ Polymer/ Diameter (nm)/ C or I | $T_g$ (° C.) | Polymer: Coupler Ratio | Pressure Δ $D_{min}$ | 1 wk 75/50 Δ @ 1.0 | 2 wk HID Δ @ 1.0 | 3 wk HID Δ @ 1.0 |
|---|---|---|---|---|---|---|
| 1/CP-2/63/C | 146 | 1:1 | 0.050 | 0.03 | −0.22 | −0.35 |
| 2/CP-2/63/C | 146 | 1.4:1 | 0.056 | 0.23 | −0.18 | −0.30 |
| 3/P-1/63/I | 39 | 1:1 | 0.030 | −0.02 | −0.18 | −0.34 |
| 4/P-2/72/I | 49 | 1:1 | 0.026 | −0.01 | −0.19 | −0.36 |
| 5/P-2/72/I | 49 | 1.4:1 | 0.018 | 0.04 | −0.15 | −0.27 |
| 6/P-1/83/I | 39 | 1:1 | 0.020 | −0.01 | −0.20 | −0.35 |
| 7/P-1/83/I | 39 | 1.4:1 | 0.017 | 0.00 | −0.17 | −0.28 |
| 8/P-1/69/I | 39 | 1:1 | 0.022 | −0.01 | −0.19 | −0.33 |
| 9/P-1/69/I | 39 | 1.4:1 | 0.020 | 0.00 | −0.14 | −0.25 |
| 10/P-2/94/I | 49 | 1:1 | 0.021 | −0.01 | −0.20 | −0.34 |
| 11/P-2/94/I | 49 | 1.4:1 | 0.022 | 0.00 | −0.16 | −0.29 |
| 12/P-5/62/I | 5 | 1:1 | 0.025 | 0.00 | −0.24 | −0.42 |
| 13/P-6/70/I | 26 | 1:1 | 0.015 | −0.01 | −0.20 | −0.36 |
| 14/P-7/58/I | 70 | 1:1 | 0.024 | −0.01 | −0.17 | −0.31 |
| 15/P-3/67/I | 53 | 1:1 | 0.018 | −0.01 | −0.19 | −0.37 |
| 16/P-3/67/I | 53 | 1.4:1 | 0.020 | −0.01 | −0.16 | −0.30 |
| 17/P-4/64/I | 63 | 1:1 | 0.021 | 0.01 | −0.17 | −0.32 |
| 18/P-8/74/I | 54 | 1:1 | 0.018 | 0.00 | −0.19 | −0.36 |
| 19/P-8/74/I | 54 | 1.4:1 | 0.022 | 0.04 | −0.18 | −0.29 |
| 20/P-9/111/I | 56 | 1:1 | 0.021 | 0.00 | −0.21 | −0.39 |
| 21/P-10/74/I | 53 | 1:1 | 0.018 | −0.01 | −0.24 | −0.44 |
| 22/P-11/59/I | 50 | 1:1 | 0.024 | −0.01 | −0.16 | −0.31 |

As can be seen from the above table, the photographic elements comprising the polymers and dispersions of the invention exhibit superior light stability, lower pressure sensitivity than the comparisons, and for a given amount of polymer, also less blue density increase during oven keeping.

EXAMPLE 3

No-solvent dispersions were made by homogenizing heated oil-phase components with the aqueous gel phases according to conventional dispersion making procedures. Surfactant F-1 was used as a dispersing aid at 10% by weight relative to coupler amount. In the examples with latex or polyoxyalkylene surfactant (F-8), these materials were added to the aqueous gel phase prior to homogenisation. Oil phase components were heated until solution (in the presence of coupler solvent) or melting (in the case of no-solvent dispersions) occurred. The following dispersions were prepared.

| Sample # | Yellow Coupler | Coupler wt % | Stabilizer ST-6 wt % | Solvent S-1 wt % | Polymer P-1 wt % | F-8 wt % | Gel wt % |
|---|---|---|---|---|---|---|---|
| 1 | Y-11 | 6.0 | 2.82 | 3.8 | — | — | 6.0 |
| 2 | Y-11 | 6.0 | 2.82 | 3.8 | 6.0 | — | 6.0 |
| 3 | Y-11 | 6.0 | 2.82 | — | — | — | 6.0 |
| 4 | Y-11 | 6.0 | 2.82 | — | 6.0 | — | 6.0 |
| 5 | Y-11 | 6.0 | 2,82 | — | 6.0 | 1.46 | 6.0 |
| 6 | Y-17 | 6.0 | 2.82 | 3.8 | — | — | 6.0 |
| 7 | Y-17 | 6.0 | 2.82 | 3.8 | 6.0 | — | 6.0 |
| 8 | Y-17 | 6.0 | 2.82 | — | — | — | 6.0 |
| 9 | Y-17 | 6.0 | 2.82 | — | 6.0 | — | 6.0 |
| 10 | Y-17 | 6.0 | 2.82 | — | 6.0 | 1.46 | 6.0 |

The dispersions were coated in a blue-sensitive color paper single-layer format with overcoat. The coating format for testing these dispersions, from the base up, is as follows:

Base: Titanium dioxide loaded polyethylene resin coated photographic paper.

Blue sensitized layer: Blue sensitized cubic silver chloride emulsion having an average cubic edge length of 0.76 $\mu$m coated at 270 mg Ag/$m^2$, Yellow dye forming coupler (Y-11 or Y-17) and polymer P-1 (each coated at 484 mg/$m^2$ in Samples 1–5 or 538 mg/$m^2$ in Samples 6–10).

UV absorbing layer: UV-2 coated at 640 mg/$m^2$, and UV-3 coated at 113 mg/$m^2$.

Overcoat: gelatin 1.08 g/$m^2$ and gelatin hardener bis (vinylsulfonyl-methyl) ether at the level of 2% based on total gel in the package.

The coatings were exposed to white light through a gray wedge chart and then processed using standard RA-4 chemistry. For the dry pressure test coatings were embossed at 5000 PSI pressure prior to processing, and the increase in yellow stain relative to unembossed coatings was measured. Light stability testing was carried out by exposing processed coatings to 50 Klux irradiation for 3 weeks, and measuring density loss from an initial density of 1.0. Thermal density change was measured by incubating processed coatings for 2 weeks at 75° C./50% RH, and measuring the change in yellow density from an initial density of 1.0.

Results from these tests and Dmax values of the coatings are shown in the following Table.

| Sample # | Dmax | Light Fade from 1.0 | Thermal Density Change from 1.0 | Dry Pressure Stain Increase |
|---|---|---|---|---|
| 1 | 2.42 | −0.32 | −0.02 | 0.027 |
| 2 | 2.45 | −0.27 | +0.15 | 0.005 |
| 3 | 1.74 | −0.36 | +0.01 | 0.076 |
| 4 | 2.33 | −0.20 | +0.08 | 0.017 |
| 5 | 2.39 | −0.21 | −0.02 | 0.017 |
| 6 | 2.30 | −0.17 | −0.01 | 0.020 |
| 7 | 2.22 | −0.14 | +0.09 | 0.000 |
| 8 | 1.48 | −0.21 | 0.00 | 0.048 |
| 9 | 1.77 | −0.15 | +0.04 | 0.009 |
| 10 | 2.16 | −0.10 | 0.00 | 0.009 |

The results in Table 1 show that the removal of coupler solvent in Samples 3 and 8 results in reactivity (Dmax) loss, worse light stability and dry pressure sensitivity compared to the corresponding coatings with coupler solvent, Samples 1 and 6. Addition of polymer latex to the no-solvent dispersions in Samples 4 and 9 shows a significant boost in reactivity and light stability, a dramatic improvement in dry pressure sensitivity, but worse thermal density change compared to the coatings without latex. Addition of polyoxyalkylene surfactant F-8 to the no-solvent dispersions with latex results in a further boost in reactivity and light stability (with coupler Y-17), and elimination of the thermal density change. Dispersions containing coupler solvent and polymer P-8 as in Samples 2 and 7 demonstrate good reactivity, light stability and dry pressure sensitivity, but worse thermal density change.

EXAMPLE 4

Dispersions were made following the procedure described in Example 3. The following dispersions were prepared (6% coupler, 6% gel).

| Sample # | Yellow Coupler | Stabilizer | Stabilizer Wt % | Solvent S-14 | Polymer P-1 | F-8 |
|---|---|---|---|---|---|---|
| 11 | Y-17 | ST-6 | 2.82 | 3.0 | 3.0 | 1.0 |
| 12 | Y-17 | ST-20 | 2.82 | 3.0 | 3.0 | 1.0 |
| 13 | Y-17 | ST-21 | 2.82 | 3.0 | 3.0 | 1.0 |
| 14 | Y-17 | ST-6/ST-22 | 2.10/0.72 | 3.0 | 3.0 | — |

Samples of dispersion were stored at 5° C. for 6 weeks, and then examined for the presence of crystals by microscopic techniques. The dispersions were also coated as described in Example 2, with coupler laydown at 538 mg/m$^2$, and exposed to white light through a gray wedge chart and then processed using standard RA-4 chemistry. In this Example, high boiling solvent S-14 was used in preparation of the dispersions. This solvent has significant water solubility and is substantially removed during the processing step resulting in a no-solvent environment for the dye in the post-processed state. Light stability testing was carried out for 3 and 7 weeks at 50 Klux. Results from these tests are shown in the following table.

| Sample | Light Fade from 1.0 | | |
|---|---|---|---|
| # | 3 Weeks | 7 Weeks | Dispersion Crystals |
| 11 | −0.08 | −0.33 | Many |
| 12 | −0.06 | −0.22 | Very few |
| 13 | −0.05 | −0.18 | None |
| 14 | −0.11 | — | Very few |

These results clearly demonstrate that crystallization problems can be avoided by suitable choice of stabilizer or mixture of stabilizers. Furthermore, optimum light stability can be obtained without crystallization problems in the dispersion.

EXAMPLE 5

It is specifically contemplated to use polymer containing coupler dispersions in accordance with the invention in a three-color multilayer color paper format, such as having the following formulation:

| LAYER | COMPONENT | AMOUNT |
|---|---|---|
| 7 | Polydimethylsiloxane | 0.027 g/m$^2$ |
| | F-1 | 0.009 g/m$^2$ |
| | F-2 | 0.0026 g/m$^2$ |
| | F-12 | 0.004 g/m$^2$ |
| | Tergitol 15-S-5 ™ | 0.003 g/m$^2$ |

-continued

| LAYER | COMPONENT | AMOUNT |
|---|---|---|
| | Gelatin | 1.076 g/m$^2$ |
| 6 | UV-1 | 0.028 g/m$^2$ |
| | UV-2 | 0.159 g/m$^2$ |
| | ST-4 | 0.038 g/m$^2$ |
| | S-8 | 0.073 g/m$^2$ |
| | Gelatin | 0.382 g/m$^2$ |
| 5 | AG-3 Red sensitive Ag | 0.187 g Ag/m$^2$ |
| | C-3 | 0.423 g/m$^2$ |
| | UV-2 | 0.272 g/m$^2$ |
| | S-1 | 0.415 g/m$^2$ |
| | S-14 | 0.035 g/m$^2$ |
| | ST-4 | 0.005 g/m$^2$ |
| | Potassium tolylthiosulfonate | 0.003 g/m$^2$ |
| | Potassium tolylsulfinate | 0.0003 g/m$^2$ |
| | Silver phenylmercaptotetrazole | 0.0009 g/m$^2$ |
| | Dye-3 | 0.023 g/m$^2$ |
| | Gelatin | 1.389 g/m$^2$ |
| 4 | UV-1 | 0.060 g/m$^2$ |
| | UV-2 | 0.342 g/m$^2$ |
| | ST-4 | 0.082 g/m$^2$ |
| | S-8 | 0.157 g/m$^2$ |
| | Gelatin | 0.822 g/m$^2$ |
| 3 | AG-2 Green sensitive Ag | 0.097 g Ag/m$^2$ |
| | M-7 | 0.317 g/m$^2$ |
| | S-1 | 0.089 g/m$^2$ |
| | Diundecylphthalate | 0.038 g/m$^2$ |
| | ST-16 | 0.190 g/m$^2$ |
| | ST-7 | 0.022 g/m$^2$ |
| | ST-19 | 0.613 g/m$^2$ |
| | 1-(3-(2-Hydroxy)benzamidophenyl)-5-mercaptotetrazole | 0.001 g/m$^2$ |
| | KCl | 0.020 g/m$^2$ |
| | BIO-1 | 0.010 mg/m$^2$ |
| | Dye-2 | 0.006 g/m$^2$ |
| | Gelatin | 1.259 g/m$^2$ |
| 2 | ST-4 | 0.108 g/m$^2$ |
| | S-1 | 0.308 g/m$^2$ |
| | ST-14 | 0.065 g/m$^2$ |
| | Irganox 1076 ™ | 0.016 g/m$^2$ |
| | F-1 | 0.011 g/m$^2$ |
| | Gelatin | 0.753 g/m$^2$ |
| 1 | AG-1 Blue sensitive Ag | 0.253 g Ag/m$^2$ |
| | Y-11 | 0.484 g/m$^2$ |
| | P-1 | 0.484 g/m$^2$ |
| | S-1 | 0.330 g/m$^2$ |
| | KCl | 0.020 g/m$^2$ |
| | ST-15 | 0.009 g/m$^2$ |
| | Dye-1 | 0.009 g/m$^2$ |
| | Gelatin | 1.528 g/m$^2$ |
| Support | Polyethylene laminated paper with $TiO_2$/ZnO in the polyethylene laminated in the first layer side. | |

Blue sensitive emulsion AG-1 may be prepared, e.g., in the following manner. A high chloride silver halide emulsion is precipitated by adding approximately equimolar silver nitrate and sodium chloride solutions into a well-stirred reactor containing gelatin peptizer and thioether ripener. $Cs_2Os(NO)Cl_5$ dopant is added during the silver halide grain formation for most of the precipitation, followed by a shelling without dopant. The resultant emulsion contains cubic shaped grains of 0.76 $\mu$m in edgelength size. This emulsion is optimally sensitized by the addition of a colloidal suspension of aurous sulfide and heat ramped up to 60° C. during which time a mixture of blue sensitizing dyes BSD-1/BSD-2 (80/20), 1-(3-acetamidophenyl)-5-mercaptotetrazole and potassium bromide are added. In addition, iridium dopant is added during the sensitization process.

Green sensitive emulsion AG-2 may be prepared in the following manner. A high chloride silver halide emulsion is precipitated by adding approximately equimolar silver nitrate and sodium chloride solutions into a well-stirred reactor containing gelatin peptizer and thioether ripener.

$Cs_2Os(NO)Cl_5$ dopant is added during the silver halide grain formation for most of the precipitation, followed by a shelling without dopant. The resultant emulsion contains cubic shaped grains of 0.30 μm in edgelength size. This emulsion is optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1, and 1-(3-acetamidophenyl)-5-mercaptotetrazole.

Red sensitive emulsion AG-3 may be prepared in the following manner. A high chloride silver halide emulsion is precipitated by equimolar addition of silver nitrate and sodium chloride solutions into a well-stirred reactor containing gelatin peptizer and thioether ripener. The resultant emulsion contains cubic shaped grains of 0.40 μm in edgelength size. This emulsion is optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium and ruthenium dopants are added during the sensitization process.

A dispersion of yellow dye-forming coupler Y-11 may be prepared by heating Y-11 and solvent S-1 until a homogeneous solution is obtained. This liquid oil solution is emulsified in an aqueous solution containing gelatin, surfactant F-1, and latex polymer P-1. Other coupler dispersions may be emulsified by methods well known to the art. Polyethlene resin coated paper support may be sized as described in U.S. Pat. No. 4,994,147 and pH adjusted as described in U.S. Pat. No. 4,917,994. The polyethylene layer coated on the emulsion side of the support may contain a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers may be hardened with bis(vinylsulfonyl methyl) ether at 1.95% of the total gelatin weight.

BSD-1

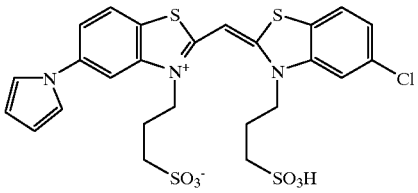

BSD-2

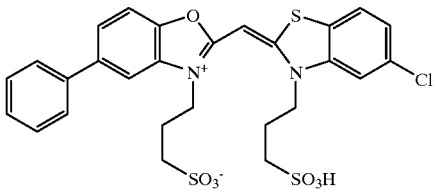

RSD-1

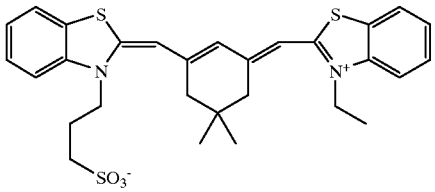

-continued

GSD-1

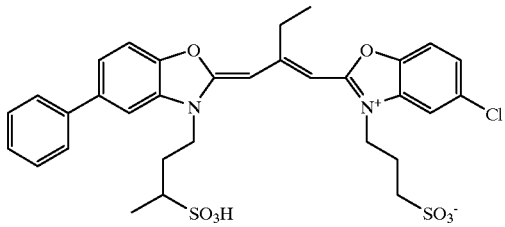

Dye-1

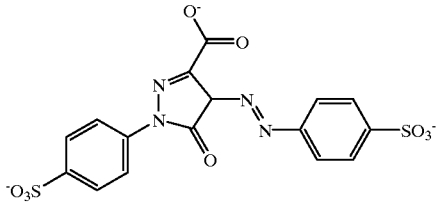

Dye-2

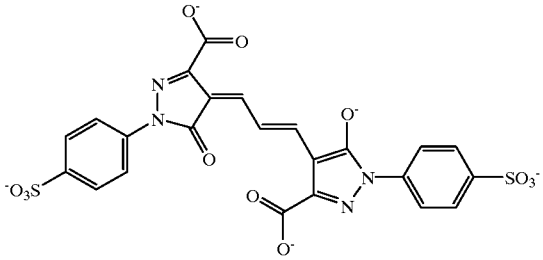

Dye-3

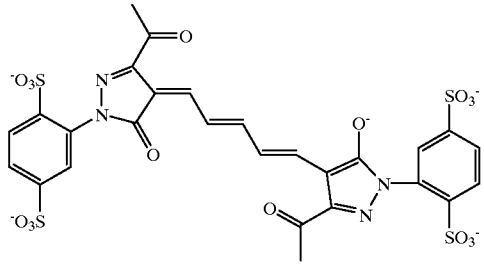

BIO-1

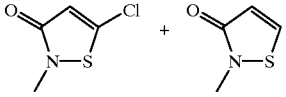

EXAMPLE 6

The following example illustrates how a balanced rate of fade can be achieved using a yellow dye-forming dispersion of this invention in combination with a highly-stable pyrazolotriazole magenta dye-forming dispersion.

Two multilayer coatings, 6-A and 6-B, were made substantially as described in Example 5, except the following changes were made. In both coatings layer 3 was replaced by layer 3' (shown below).

| Layer 3' | |
|---|---|
| AG-2 Green Sensitive Ag | 0.172 g/m$^2$ |
| M-13 | 0.323 g/m$^2$ |
| ST-1 | 0.162 g/m$^2$ |

-continued

| Layer 3' | |
|---|---|
| S-1 | 0.484 g/m$^2$ |
| 1-3-(2-Hydroxy)benzamidophenyl)-5-mercaptotetrazole | 0.001 g/m$^2$ |
| KCl | 0.020 g/m$^2$ |
| BIO-1 | 0.010 g/m$^2$ |
| Dye-2 | 0.006 g/m$^2$ |
| Gelatin | 1.259 g/m$^2$ |

In coating 6-A, layer 1 was replaced by layer 1', and in coating 6-B, layer 1 was replaced by 1", both shown below.

| | Layer 1' | Layer 1" |
|---|---|---|
| AG-1 Blue Sensitive Ag | 0.253 g/m$^2$ | 0.253 g/m$^2$ |
| Y-17 | 0.538 g/m$^2$ | 0.538 g/m$^2$ |
| ST-20 | 0.253 g/m$^2$ | 0.253 g/m$^2$ |
| S-1 | 0.341 g/m$^2$ | — |
| S-14 | — | 0.269 g/m$^2$ |
| P-1 | — | 0.269 g/m$^2$ |
| F-8 | — | 0.090 g/m$^2$ |
| KCl | 0.020 g/m$^2$ | 0.020 g/m$^2$ |
| ST-15 | 0.009 g/m$^2$ | 0.009 g/m$^2$ |
| Dye-1 | 0.009 g/m$^2$ | 0.009 g/m$^2$ |
| Gelatin | 1.528 g/m$^2$ | 1.528 g/m$^2$ |

Coatings 6-A and 6-B were exposed and processed using standard RA-4 chemistry. Light stability testing was carried out on cyan, magenta and yellow dye patches from the multilayers using 50 Klux exposures for 3 weeks. Fade numbers from a density of 1.0 are shown in the table below.

| Light fade from 1.0 | | | |
|---|---|---|---|
| Cyan | Magenta | Yellow 1' | Yellow 1" |
| −0.09 | −0.06 | −0.17 | −0.06 |

These results show that a much closer balance in fade numbers for the three layers can be obtained by using a suitable latex polymer in the yellow dye-forming layer. Comparing faded prints made from the two multilayers would show skin patches turning blue with yellow 1', but remaining close to the original color with yellow 1".

The invention has been described in detail with particular reference to preferred embodiments; thereof, but it will be understood that variations and modifications can be effected within the spirit and scope of the invention.

We claim:

1. A photographic element comprising a support bearing at least one light sensitive silver halide emulsion layer comprising a dispersion of a dye-forming coupler and a water-insoluble polymer, wherein the polymer has a glass transition temperature ($T_g$) less than 75° C. and is formed from at least 30 wt % monomer units which provide the polymer with functional groups that are hydrogen bond donors.

2. The element of claim 1 wherein the polymer has a $T_g$ of less than about 60° C.

3. The element of claim 1 wherein the polymer has a $T_g$ of less than about 45° C.

4. The element of claim 1 wherein the polymer has a $T_g$ of less than or equal to about 40° C.

5. The element of claim 1 where in the polymer is a copolymer of a monomer capable of H-bond donation that forms a homopolymer with a $T_g$ greater than about 80° C., with a ethylenically unsaturated comonomer that forms a homopolymer with a $T_g$ less than about 40° C.

6. The element of claim 5 wherein the polymer is a copolymer of an alkylacrylamide capable of H-bond donation, with a ethylenically unsaturated comonomer that forms a homopolymer with a $T_g$ less than about 40° C.

7. The element of claim 6 wherein the polymer is a copolymer of an alkylacrylamide and an acrylate ester.

8. The element of claim 1 wherein the polymer is a latex prepared by emulsion polymerization.

9. The element of claim 8 wherein the latex comprises between about 1–10% by weight of an anionic monomer.

10. The element of claim 8 wherein the dispersion is a loaded latex dispersion of the dye-forming coupler and the polymer latex.

11. The element of claim 1 wherein the dye-forming coupler is a yellow dye-forming coupler.

12. The element of claim 11 wherein the yellow dye-forming coupler is an acylacetanilide compound.

13. The element of claim 11 wherein the yellow dye-forming coupler is a pivaloylacetanilide compound.

14. The element of claim 11, wherein the yellow dye-forming coupler and water-insoluble polymer are present in a blue-sensitive silver halide emulsion layer and further comprising a light-sensitive silver halide emulsion layer comprising a pyrazolotriazole magenta dye-forming coupler.

15. A photographic element according to claim 11, wherein the silver halide emulsion layer comprises a blue-sensitive silver-halide emulsion, and the polymer comprises a copolymer derived from ethylenically unsaturated monomers, said copolymer comprising between 30–80% by weight of a monomer with functional groups that are hydrogen bond donors, and at least 20% by weight of a monomer with lower water solubility than the monomer that is the hydrogen bond donor.

16. The photographic element of claim 15 wherein the polymer is a copolymer comprising between 30–80% by weight of an alkylacrylamide monomer, and at least 20% by weight of a monomer with lower water solubility than the alkylacrylamide monomer.

17. The photographic element of claim 15 wherein the polymer is a copolymer comprising between 30–80% by weight of an alkylacrylamide monomer, and at least 20% by weight of a monomer selected from styrene, substituted styrene, an acrylate ester, or a methacrylate ester.

18. The photographic element of claim 11, wherein the dispersion of a dye-forming coupler and a water-insoluble polymer is substantially free of water-insoluble permanent coupler solvent.

19. The photographic element of claim 18, wherein the silver halide emulsion layer further comprises a polyoxyalkylene compound.

20. The photographic element of claim 19, wherein the polyoxyalkylene compound comprises a block polymeric or block oligomeric surface active compound comprising at least a polyoxypropylene block and a polyoxyethylene block.

21. The photographic element of claim 11, wherein the polymer comprises at least 35 wt % monomer units which provide the polymer with functional groups that are hydrogen bond donors.

22. The photographic element of claim 11, wherein the polymer comprises at least 50 wt % monomer units which provide the polymer with functional groups that are hydrogen bond donors.

23. The photographic element of claim 1, wherein the dispersion of a dye-forming coupler and a water-insoluble polymer is substantially free of water-insoluble permanent coupler solvent.

24. The photographic element of claim 23, wherein the silver halide emulsion layer further comprises a polyoxyalkylene compound.

25. The photographic element of claim 24, wherein the polyoxyalkylene compound comprises a block polymeric or block oligomeric surface active compound comprising at least a polyoxypropylene block and a polyoxyethylene block.

26. The photographic element of claim 1, wherein the polymer comprises at least 35 wt % monomer units which provide the polymer with functional groups that are hydrogen bond donors.

27. The photographic element of claim 1, wherein the polymer comprises at least 50 wt % monomer units which provide the polymer with functional groups that are hydrogen bond donors.

* * * * *